US009551201B2

(12) United States Patent
Ring et al.

(10) Patent No.: US 9,551,201 B2
(45) **Date of Patent: *Jan. 24, 2017**

(54) APPARATUS AND METHOD OF ZONAL ISOLATION

(71) Applicant: Weatherford Technology Holdings, LLC, Houston, TX (US)

(72) Inventors: Lev Ring, Houston, TX (US); Varadaraju Gandikota, Cypress, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 339 days.

This patent is subject to a terminal disclaimer.

(21) Appl. No.: 14/156,178

(22) Filed: Jan. 15, 2014

(65) Prior Publication Data

US 2014/0196914 A1 Jul. 17, 2014

Related U.S. Application Data

(63) Continuation of application No. PCT/US2012/047221, filed on Jul. 18, 2012, and a
(Continued)

(51) Int. Cl.
*E21B 33/12* (2006.01)
*E21B 33/124* (2006.01)
(Continued)

(52) U.S. Cl.
CPC ..... *E21B 33/12* (2013.01); *E21B 23/06* (2013.01); *E21B 33/124* (2013.01);
(Continued)

(58) Field of Classification Search
CPC ..... E21B 43/103; E21B 23/06; E21B 33/124; E21B 43/105; E21B 33/12; E21B 33/1208
See application file for complete search history.

(56) References Cited

U.S. PATENT DOCUMENTS 2,748,463 A 6/1956 Mueller
2,812,025 A 11/1957 Teague et al.
(Continued)

FOREIGN PATENT DOCUMENTS

GB 2426993 A 12/2006
JP 57058931 A 4/1982
WO 2004/007892 A2 1/2004

OTHER PUBLICATIONS

Canadian Office Action dated Feb. 5, 2015, for Canadian Patent Application No. 2,842,065.
(Continued)

*Primary Examiner* — Blake Michener
(74) *Attorney, Agent, or Firm* — Patterson & Sheridan LLP

(57) ABSTRACT

Methods and apparatus include an expandable packer having a tubing expanded to create a seal in an annulus surrounding the tubing. The tubing includes a non-uniform outer surface configured to cause formation of undulations in a diameter of the tubing upon expansion of the tubing. A plurality of expandable packers may be connected to a tubular string to isolate multiple zones in a wellbore. A production tubular equipped with multiple expandable packers may be installed in the tubular string. The expandable packers may also include non-uniform outer surfaces configured to form undulations upon expansion. The combination of tubular string and production tubular may be used in an enhanced oil recovery application such as injecting steam into a formation to enhance production.

22 Claims, 23 Drawing Sheets

Related U.S. Application Data continuation-in-part of application No. 13/942,456, filed on Jul. 15, 2013, now Pat. No. 8,967,281, which is a continuation of application No. 13/523,656, filed on Jun. 14, 2012, now Pat. No. 8,499,844, which is a continuation of application No. 12/389,090, filed on Feb. 19, 2009, now Pat. No. 8,201,636.

(60) Provisional application No. 61/508,952, filed on Jul. 18, 2011, provisional application No. 61/029,634, filed on Feb. 19, 2008.

(51) Int. Cl.
*E21B 23/06* (2006.01)
*E21B 43/10* (2006.01)

(52) U.S. Cl.
CPC ..... *E21B 43/103* (2013.01); *E21B 43/105* (2013.01); *E21B 33/1208* (2013.01)

(56) References Cited

U.S. PATENT DOCUMENTS 2,890,724 A 6/1959 Kennedy, Jr.
3,138,761 A 6/1964 Matteo
3,162,245 A 12/1964 Howard et al.
3,358,760 A 12/1967 Blagg
3,385,367 A 5/1968 Kollsman
3,412,565 A 11/1968 Lindsey et al.
3,432,916 A 3/1969 Reichert
3,477,506 A 11/1969 Malone
3,667,543 A 6/1972 Dean
3,669,190 A 6/1972 Sizer et al.
3,722,588 A 3/1973 Tamplen
3,776,307 A 12/1973 Young
3,997,193 A 12/1976 Tsuda et al.
4,006,619 A 2/1977 Anderson
4,067,386 A 1/1978 Weise
4,068,372 A 1/1978 Kamohara et al.
4,069,573 A 1/1978 Rogers, Jr. et al.
4,193,105 A 3/1980 Graafmann
4,349,204 A 9/1982 Malone
4,387,507 A 6/1983 Kelly
4,388,752 A 6/1983 Vinciguerra et al.
4,418,457 A 12/1983 Mueller
4,422,317 A 12/1983 Mueller
4,567,631 A 2/1986 Kelly
4,581,817 A 4/1986 Kelly
4,614,346 A * 9/1986 Ito ..... F16J 15/46 166/187
4,724,693 A 2/1988 Tedder
4,892,144 A * 1/1990 Coone ..... E21B 33/1295 166/122
4,923,007 A 5/1990 Sanford et al.
4,976,322 A 12/1990 Abdrakhmanov et al.
5,052,483 A 10/1991 Hudson
5,337,823 A 8/1994 Nobileau
5,667,252 A 9/1997 Schafer et al.
5,794,702 A 8/1998 Nobileau
5,923,007 A 7/1999 Emmert
6,123,148 A 9/2000 Oneal
6,135,208 A 10/2000 Gano et al.
6,138,761 A 10/2000 Freeman et al.
6,325,148 B1 12/2001 Trahan et al.
6,409,226 B1 6/2002 Slack et al.
6,640,893 B1 11/2003 Rummel et al.
6,691,786 B2 2/2004 Patel
6,691,789 B2 2/2004 Jackson et al.
6,712,151 B2 3/2004 Simpson et al.
6,742,598 B2 6/2004 Whitelaw et al.
6,789,622 B1 9/2004 Ducasse et al.
6,860,329 B1 3/2005 Oosterling
6,964,305 B2 11/2005 McMahan et al.
7,017,669 B2 3/2006 Johnston et al.
7,017,670 B2 3/2006 Hazel et al.
7,073,583 B2 7/2006 Anderton et al.
7,090,006 B2 * 8/2006 Salama ..... E21B 17/01 138/98
7,152,679 B2 12/2006 Simpson
7,168,497 B2 1/2007 Metcalfe et al.
7,228,896 B2 6/2007 Gazewood
7,306,033 B2 12/2007 Gorrara
7,350,584 B2 4/2008 Simpson et al.
7,350,585 B2 4/2008 Simpson et al.
7,360,591 B2 4/2008 Ring
7,360,592 B2 4/2008 McMahan
7,493,945 B2 2/2009 Doane et al.
7,578,354 B2 8/2009 Thomson
7,699,115 B2 4/2010 Baaijens et al.
7,779,924 B2 8/2010 Clamens
7,828,068 B2 11/2010 Gano et al.
9,217,308 B2 12/2015 Wood et al.
2002/0092654 A1 7/2002 Coronado et al.
2002/0195256 A1 12/2002 Metcalfe et al.
2003/0042022 A1 3/2003 Lauritzen et al.
2003/0116328 A1 6/2003 Doane et al.
2004/0074640 A1 4/2004 Anderton et al.
2004/0112609 A1 6/2004 Whanger et al.
2004/0216894 A1 11/2004 Maguire
2004/0226723 A1 11/2004 Simpson
2004/0244994 A1 12/2004 Jackson et al.
2005/0000697 A1 1/2005 Abercrombie Simpson et al.
2005/0023003 A1 2/2005 Echols et al.
2005/0057005 A1 3/2005 Simpson et al.
2005/0072579 A1 * 4/2005 Gambier ..... E21B 33/1277 166/387
2005/0077052 A1 4/2005 Ohmer
2005/0127673 A1 6/2005 Simpson et al.
2005/0217865 A1 10/2005 Ring
2006/0016597 A1 1/2006 Emerson
2006/0042801 A1 3/2006 Hackworth et al.
2006/0090903 A1 5/2006 Gano et al.
2006/0266530 A1 11/2006 Echols
2006/0283607 A1 12/2006 Duggan et al.
2007/0000664 A1 1/2007 Ring et al.
2007/0205002 A1 9/2007 Baaijens et al.
2008/0000646 A1 1/2008 Thomson
2008/0142219 A1 6/2008 Steele et al.
2008/0236230 A1 10/2008 Brisco et al.
2009/0205843 A1 8/2009 Gandikota et al.
2014/0190683 A1 7/2014 Hallundbaek et al.
2014/0299334 A1 10/2014 Hallundbaek et al.

OTHER PUBLICATIONS

Australian Examination Report for Patent Application No. 2012284104 dated Apr. 14, 2015.
PCT Search Report and Written Opinion for International Application No. PCT/US2012/047221 dated Jun. 25, 2013.
Dictionary Definitions of "undulation", accessed Aug. 5, 2011 on www.thefreedictionary.com.
Massey; Welltec; In-Situ Hydroforming of an Annular Barrier in Oil Wells; dated Oct. 9, 2014; 20 total pages.

* cited by examiner

APPARATUS AND METHOD OF ZONAL ISOLATION

CROSS-REFERENCE TO RELATED APPLICATIONS

This application is a continuation of International Application No. PCT/US2012/047221, filed Jul. 18, 2012, which application claims benefit of U.S. Provisional Patent Application Ser. No. 61/508,952, filed Jul. 18, 2011. This application is also a continuation-in-part of U.S. patent application Ser. No. 13/942,456, filed Jul. 15, 2013; which application is a continuation U.S. patent application Ser. No. 13/523,656, filed Jun. 14, 2012, now U.S. Pat. No. 8,499,844; which application is a continuation of U.S. patent application Ser. No. 12/389,090, filed Feb. 19, 2009, now U.S. Pat. No. 8,201,636; which application claims benefit of U.S. provisional patent application Ser. No. 61/029,634, filed Feb. 19, 2008. Each of the aforementioned applications is incorporated herein by reference in its entirety.

BACKGROUND OF THE INVENTION

Field of the Invention

Embodiments of the invention generally relate to expandable tubing assemblies and expanding such assemblies to seal a surrounding annulus.

Description of the Related Art

Drilling a bore into the earth enables access to hydrocarbons in subsurface formations. The process of drilling a borehole and of subsequently completing the borehole in order to form a wellbore requires the use of various tubular strings. Methods and apparatus utilized in the oil and gas industry enable placing tubular strings in a borehole and then expanding the circumference of the strings in order increase a fluid path through the tubing and in some cases to line the walls of the borehole. Some of the advantages of expanding tubing in a borehole include relative ease and lower expense of handling smaller diameter tubing and ability to mitigate or eliminate formation of a restriction caused by the tubing.

Many applications require creating a seal around one of the tubular strings in the wellbore such that fluid flow through a surrounding annulus is blocked. Various types of conventional packers exist that may be set for this purpose without expanding an inside diameter of the tubing. Further, expandable tubing may include a band of elastomeric material disposed on its outer surface to facilitate sealing. However, these bands produce sealing that is localized only at the band and often unreliable due to spring back effect resulting in low seal pressure being achieved.

Therefore, there exists a need for apparatus and methods to improve sealing around tubing that has been expanded.

SUMMARY OF THE INVENTION

Embodiments of the invention generally relate to expansion of tubing to create a seal in an annulus surrounding the tubing. A method in one embodiment expands a packer assembly that includes tubing with a sealing element disposed on an outside surface thereof. The sealing element defines thick bands alternating with thin bands that protrude from the outside surface of the tubing less than the thick bands. The method includes expanding the tubing such that relatively greater expansion occurs at where the thin bands are located compared to where the thick bands are located.

In one embodiment, a method of isolating multiple zones in a wellbore includes providing a tubular string having a plurality of expandable packers, wherein each of the plurality of expandable packers include a tubing have a sealing element and the sealing element includes a non-uniform outer diameter; positioning the plurality of expandable packers adjacent the zones for isolation; and expanding the sealing element into engagement with the wellbore; thereby creating undulations in a diameter of the tubing based on the non-uniform outer diameter of the sealing element along a length of the tubing. In another embodiment, the method also includes positioning a production tubular in the tubular string, the production tubular having a plurality of expandable packers; and expanding the plurality of expandable packers of the production tubular against the tubular string. In yet another embodiment, the non-uniform outer diameter includes alternating unchanged outer diameter section and reduced outer diameter sections of the tubing. The method may be used in enhanced oil recovery applications to inject steam into the formation in order to reduce oil viscosity.

A method of expanding a packer assembly for one embodiment includes running tubing with a sealing element disposed on an outside surface thereof into a wellbore. The method includes placing the sealing element into engagement with a surrounding surface. Further, creating undulations in a diameter of the tubing occurs based on alternating first and second properties of the sealing element along a length of the tubing.

According to another embodiment, an expandable packer assembly includes tubing having unexpanded and expanded positions. A sealing element disposed on an outside of the tubing defines thick bands alternating along a length of the tubing with thin bands that protrude from the outside of the tubing less than the thick bands. An inner diameter of the tubing along the length is uniform in the unexpanded position and undulations in the inner diameter are at the thin bands in the expanded position.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of the invention generally relate to expansion of tubing to create a seal in an annulus surrounding the tubing. The tubing includes a sealing material selected to cause formation of undulations in a diameter of the tubing upon expansion of the tubing. The tubing with the sealing material provides improved sealing performance.

Figure 1:
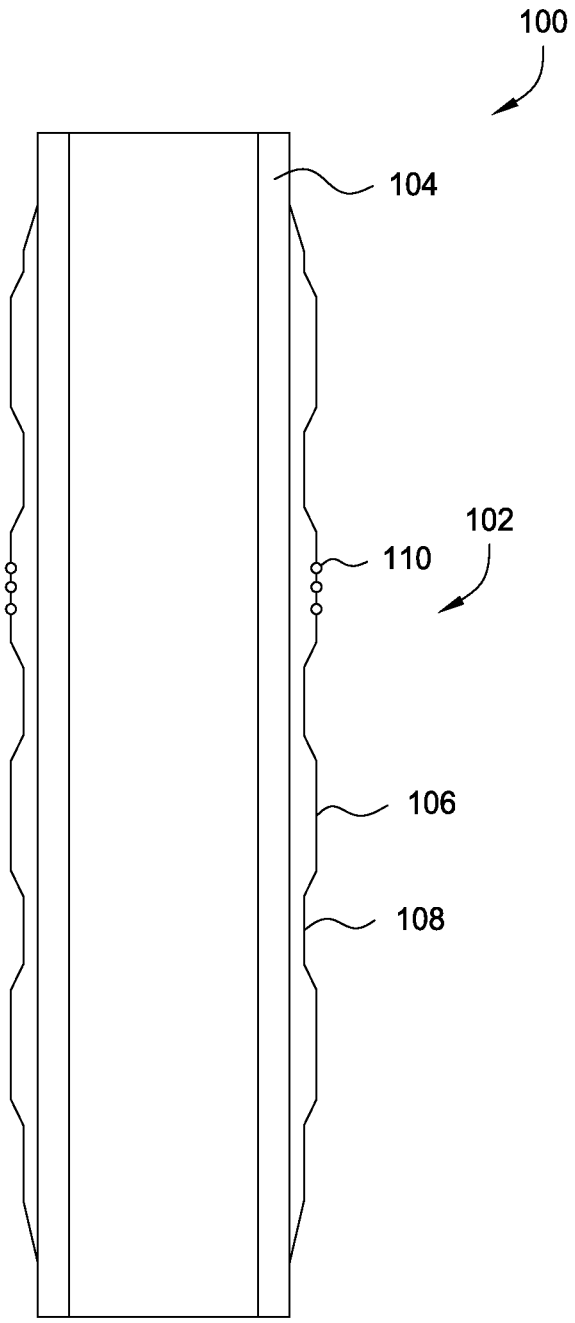
FIG. 1 is a cross-section view of an expandable packer in a pre-expansion run-in position with a profiled sealing material disposed around base tubing.

FIG. 1 illustrates an exemplary expandable packer 100 in a pre-expansion run-in position with a profiled sealing material 102 disposed on an outside of base tubing 104. The sealing material 102 may include an elastomeric material or non-elastomeric, ductile material such as soft metal that is wrapped or molded or positioned around the tubing 104 continuously along a length of the tubing 104 that may include all or part of the tubing 104. Along this length of the tubing 104 where the sealing material 102 extends, a property (e.g., thickness, compressibility, hardness or swelling extent) of the sealing material 102 may be varied to achieve post expansion results as described further herein. Consistency of the profiled sealing material 102 can use hard, soft or swellable elastomeric material or a combination thereof to achieve desired high pressure sealing for cased hole or open-hole conditions. In some embodiments, the variation of the sealing material 102 occurs along a section of the tubing 104 at least in part due to discontinuity of the sealing material 102. For example, a longitudinal break in the sealing material 102 may leave the tubing 104 without the sealing material 102 at the break.

By way of example since thickness is suitable for illustration, the profiled sealing material 102 defines a topography that alternates lengthwise over the tubing 104 between thick bands 106 of the sealing material 102 that occupy a greater annular area than thin bands 108 of the sealing material 102. Each of the bands 106, 108 circumscribe the tubing 104 to form a ring shape oriented transverse to a longitudinal bore of the tubing 104. The expandable packer 100 may utilize any number of the bands 106, 108 and in some embodiments has at least one of the thick bands 106 disposed between two of the thin bands 108.

Machining of the sealing material 102 from an initially uniform thickness may create differences in the thickness of the bands 106, 108. Further, separate additional outer sleeves may add to thickness of the sealing material 102 at the thick bands 106. Tailored molding of the sealing material 102 offers another exemplary approach to provide the differences in the thickness between the bands 106, 108 of the sealing material 102.

For some embodiments, a gripping structure or material may be located on the outside of the tubing 104 such that when the tubing 104 is expanded the gripping structure or material moves outward in a radial direction and engages a surrounding surface (e.g., casing or open borehole) to facilitate in anchoring the tubing 104 in place. As an example, the expandable packer 100 includes a grit 110 disposed on the outside of the tubing 104. The grit 110 such as tungsten carbide or silicon carbide may adhere to any portion of the tubing 104 that is to be expanded. In some embodiments, the sealing material 102 at one or more of the thin bands 108 include the grit 110 that is coated on or embedded therein. In another embodiment, the grit 110 may be included on one or more of the thick bands 106, thin bands 108, or combinations thereof.

Figure 2:
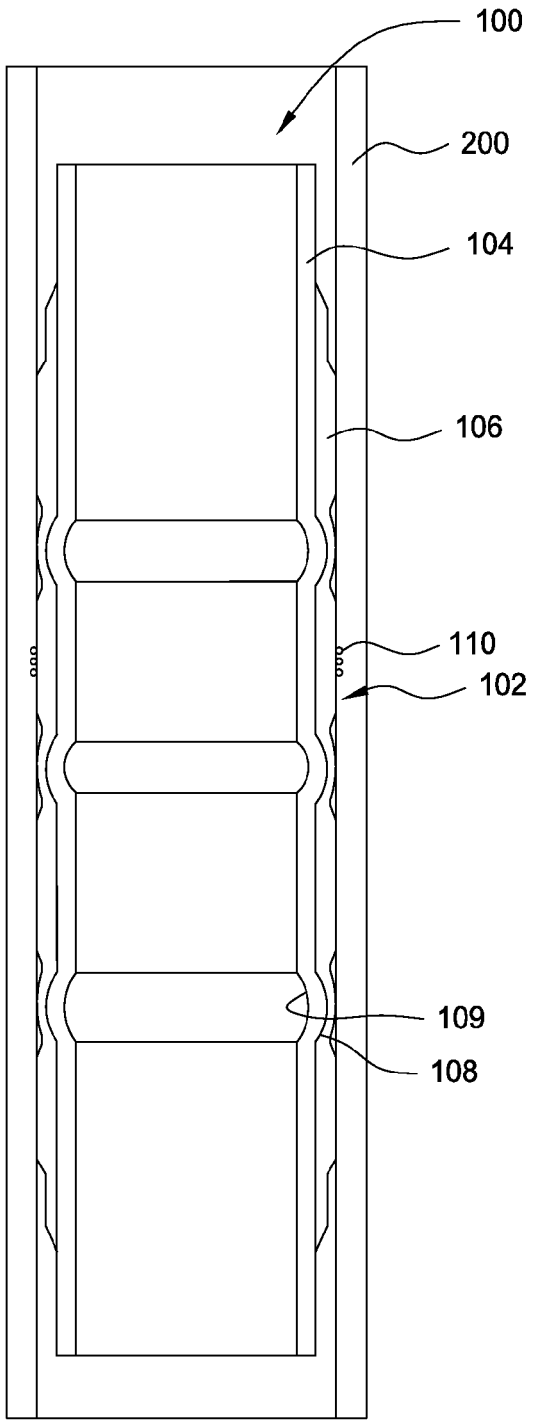
FIG. 2 is a cross-section view of the expandable packer in an expanded position within a surrounding structure such as casing.

FIG. 2 shows the expandable packer 100 in an expanded position within a surrounding structure such as an open borehole or casing 200. Upon expansion, the tubing 104 plastically deforms selectively creating undulations 109 resulting in high pressure sealing. The grit 110, if present, also embeds in the casing 200 upon expansion to aid in hanging the expandable packer 100. The undulations 109 occur as a result of and where the thin bands 108 of the sealing material 102 permit relatively greater radial expansion of the tubing 104. While not expanded as much, the tubing 104 corresponding to where the thick bands 106 of the sealing material 102 are located also deforms in a radial outward direction to place the thick bands 106 into engagement with the casing 200. Design of the sealing material 102 thus creates a specific pattern of the undulations 109 after expansion.

Expansion of the tubing 104 may occur utilizing an inflatable expander having a flexible bladder that is pressurized into contact with the inside of the tubing 104. For some embodiments, a compliant (i.e., not a fixed diameter during expansion) cone or a compliant rotary expander tool can achieve expansion of the tubing 104. Further, hydroforming techniques using only fluid pressure to act directly against an inside surface of the tubing 104 may expand the tubing 104. Such hydroforming of the tubing 104 employs seals spaced apart inside the tubing 104 such that hydraulic pressure may be applied to an interior volume of the tubing 104 between the seals.

One potential cause for loss of sealing occurs if the fluid pressure in the annulus between the tubing 104 and wellbore causes the tubing 104 to collapse, thereby pulling the sealing element 102 away from its sealing engagement with the casing 200. The undulations 109 tend to increase collapse resistance of the tubing 104 compared to tubing which has been expanded to have a constant diameter. Thus, the increase in collapse resistance benefits sealing ability of the sealing element 102. Further, the undulations 109 at least reduce any potential decreases in seal load as a result of elastic recovery of the tubing 104 immediately after expansion. The undulations 109 may experience less elastic recovery than when a longer length of the tubing 104 is expanded, thereby mitigating the effect of the elastic recovery to cause removal of the seal load. While it is believed that these mechanisms enhance sealing performance as determined by test data results described herein, other factors without limitation to any particular theory may alone or in combination cause the improvements in the sealing performance obtained.

Figure 3:
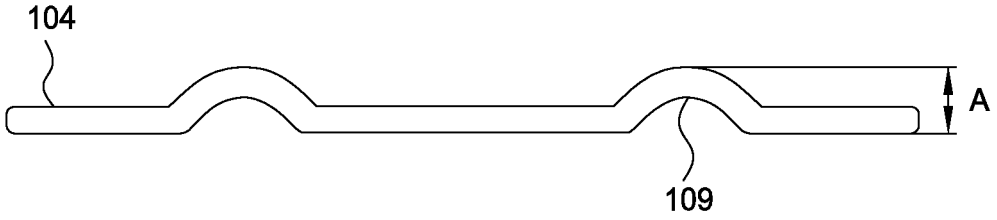
FIG. 3 is a schematic illustration showing amplitude of undulations created in the base tubing upon expansion as a result of the profiled sealing material.

FIG. 3 schematically illustrates amplitude (A) of the undulations 109 created in the tubing 104 upon expanding. In particular, the amplitude as identified represents extent of localized radial deformation defined as difference between an inner diameter of the tubing 104 adjacent the undulation 109 and an outer diameter of the tubing 104 at a peak of the undulation 109. The undulations 109 created in part due to the profiled sealing material 102 influence sealing performance of the expandable packer 100.

Figure 4:
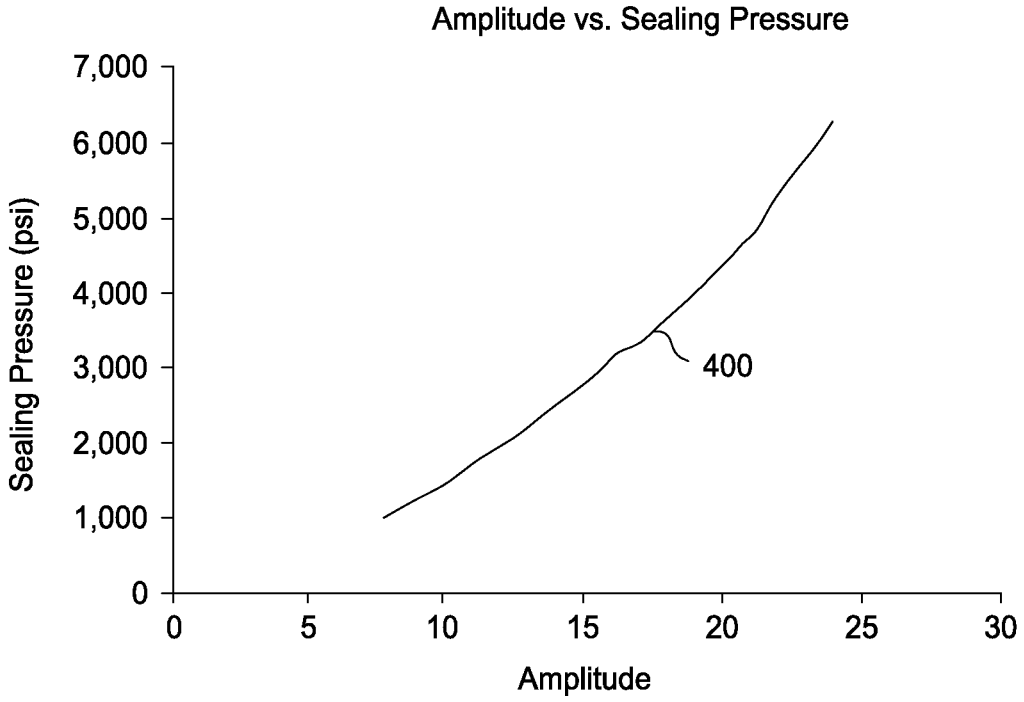
FIG. 4 is a graph depicting sealing pressure performance as a function of the amplitude.

FIG. 4 in particular shows a graph depicting sealing pressure performance as a function of the amplitude characterized as a generic unit length. The sealing pressure performance for this amplitude based analysis occurs as a result of discrete localized sealing engagement at only the undulations 109 without sealing engagement extending over a substantial length of the tubing 104. The results shown demonstrate that sealing pressure achievable trends higher along an amplitude curve 400 with increase in the amplitude. Selection of the amplitude can alter sealing pressure achievable by several multiples. It is to be noted that this illustrates one embodiment of a sealing arrangement where the undulations 109 are formed and only the thin bands 108 contact and create a seal with the surrounding structure. In another embodiment, upon expansion, the undulations 109 are formed but only the thick bands 106 contact and create a seal with the surrounding structure. In a further embodiment, upon expansion, the undulations 109 are formed and the thin bands 108 contact the surrounding structure while only the thick bands 106 create a seal with the surrounding structure. In yet a further embodiment, upon expansion, the undulations 109 are formed whereby both the thin bands 108 and the thick bands 106 contact and create a seal with the surrounding structure.

Several design factors of the sealing element 102 influence generation of the undulations 109 and resulting seal created by the expandable packer 100. Factors that can influence the amplitude achieved and enable creation of the amplitude that is sufficiently high to provide the seal performance desired include a thickness deviation ratio between the thick and thin bands 106, 108 of the sealing element 102, a pitch of the sealing element 102 as defined by distance between the thick bands 106, the number of undulations 109, the number of bands 106, 108 and the material and dimensional properties of the tubing 104, such as yield strength, ductility, wall thickness and diameter. These design factors in combination with the radial expansion force applied by the expander tool control the amplitude of the undulation 109.

Figure 5:
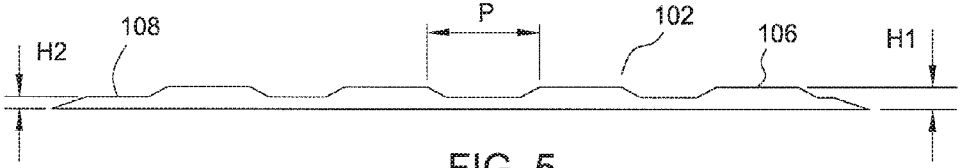
FIG. 5 is a schematic illustration showing a thickness deviation ratio and pitch defined by topography of the profiled sealing material.

FIG. 5 illustrates a max height (H1) of the thick band 106 protruding from the tubing 104 and an intermediate height (H2) determined by protrusion of the thin band 108. The thickness deviation ratio equals H1/H2. The pitch (P) as shown represents longitudinal distance between the max heights of two consecutive ones of the thick bands 106. The pitch and the thickness deviation ratio play an important role for high pressure sealing through radial expansion of the packer assembly 100.

Figure 6:
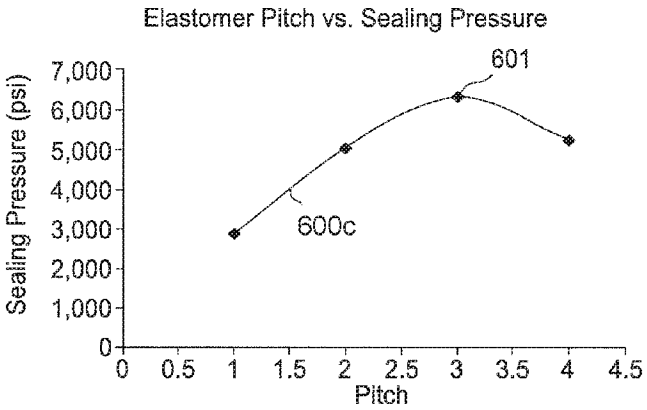
FIG. 6 is a graph depicting sealing pressure performance as a function of the pitch.

FIG. 6 shows a graph depicting sealing pressure performance as a function of the pitch characterized as a generic unit length. The dimension of the pitch in combination with the physical and dimensional parameters of the material has an effect on the curvature of the undulations 109 being formed. For a given material and a given set of dimensions a shorter pitch results in a less undulation and a longer pitch results in a greater undulation. By varying the parameters, the curvature of undulation is altered. Shorter pitch results in lower sealing pressure as sufficient values for the amplitude cannot be generated during expansion. Further, broadening out of the undulation 109 along the tubing 104 as occurs when the pitch increases beyond that required to achieve the amplitude desired can decrease sealing pressure. A pitch curve 600*c* demonstrates that the sealing pressure increases with increase in the pitch up to a threshold for the pitch at which point further increase in the pitch reduces the sealing pressure. For any given application with specific criteria such as pre-expansion diameter and wall thickness of the tubing 104, analytical/empirical models may enable selection of the pitch to achieve a maximum seal performance as identified by point 601 along the pitch curve 600*c*.

Figure 7:
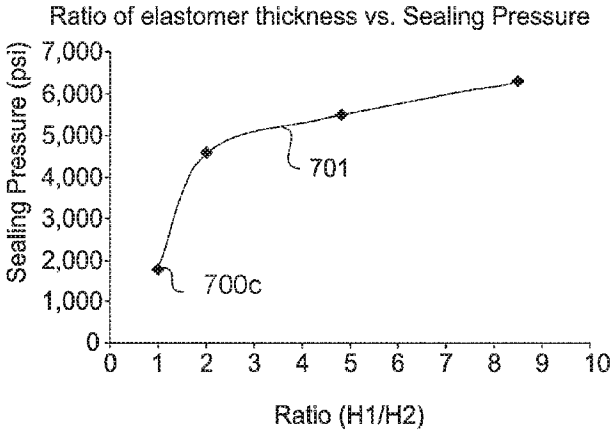
FIG. 7 is a graph depicting sealing pressure performance as a function of the thickness deviation ratio.

FIG. 7 illustrates a graph depicting sealing pressure performance as a function of the thickness deviation ratio. The seal pressure performance improves when the ratio increases (i.e., increasing the maximum height of the thick bands 106 of the sealing element 102 and/or decreasing the intermediate height provided by the thin bands 108 of the sealing element 102). As the thickness deviation ratio increases from one to two to provide the thick band 106 protruding twice as far as the thin band 108, the sealing pressure achievable increases along a ratio curve 701 by a factor greater than two. Further increases in the thickness deviation ratio result in slower continued increase in the sealing pressure. For some embodiments, the ratio is selected to be between 1.25 and 5.0, between 1.5 and 2.5, or between 1.75 and 2.25.

As a comparative example, point 700*c* on the ratio curve 701 corresponds to prior sealing elements having a uniform thickness across a length that is expanded into sealing engagement such that no undulations exist. Such prior sealing elements can, based on location of the point 700*c*, only maintain sealing at pressures below about 1800 pounds per square inch (psi) (12,410 kilopascal (kPa)).

Figure 8:
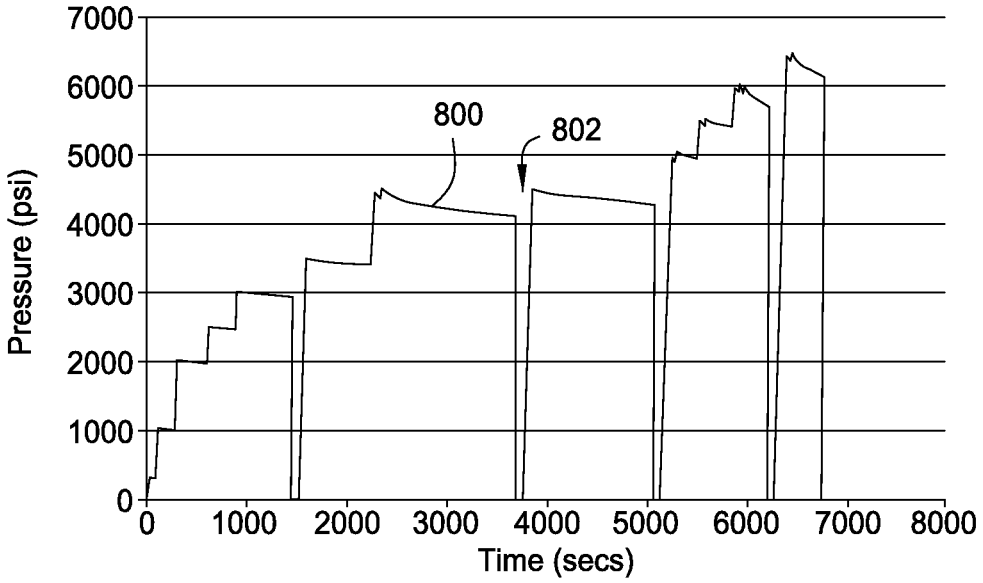
FIGS. 8 and 9 are plots of data from seal pressure tests of the expandable packer at about 22° C. and 100° C., respectively.
Figure 9:
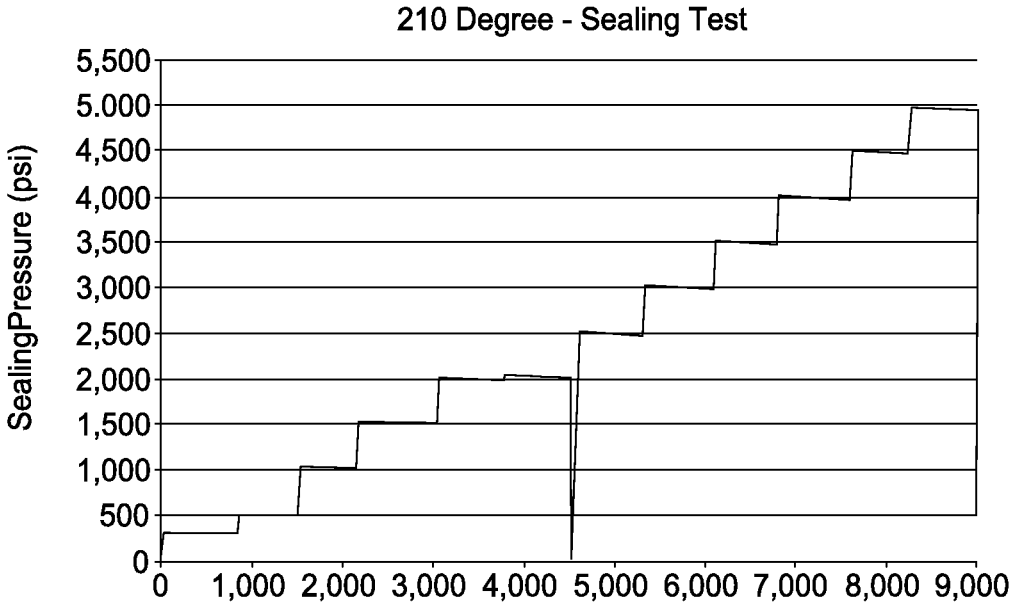

FIGS. 8 and 9 show plots of data from seal pressure tests of the expandable packer 100 at about 22° C. and 100° C., respectively. The expandable packer 100 was tested up to 6500 psi (44,815 kPa) without sealing failure which illustrates the ability to select attributes to create undulations as set forth herein to obtain a much higher seal pressure as compared to prior sealing elements which by comparison would only maintain pressures of about 1800 psi. Downward trending 800 occurs over time once each of the pressures tested is initially reached as a result of equilibration as the sealing material 102 further compresses. In addition, drop offs 802 at certain times in the plots occur due to intentional pressure relief prior to further pressurization and not any failure of the sealing by the expandable packer 100.

Figure 10:
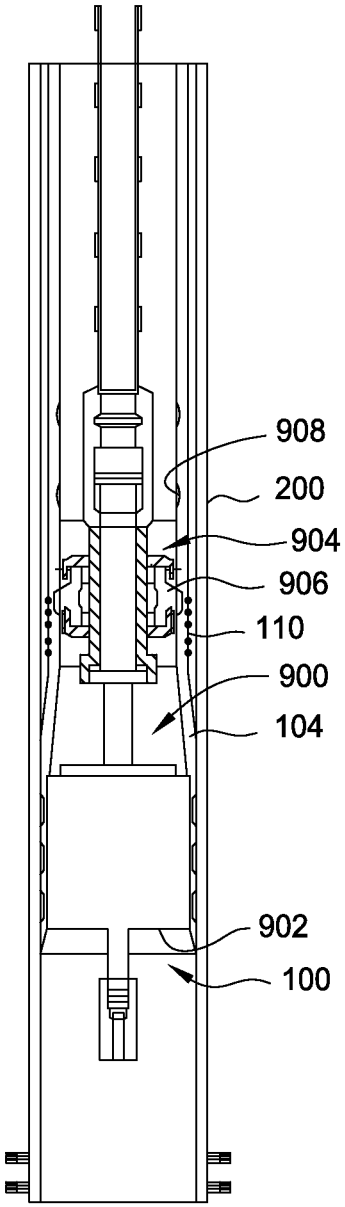
FIG. 10 is a cross section view of the expandable packer during an expansion operation with an exemplary expander tool such as an inflatable device with a locating mechanism.

FIG. 10 illustrates the expandable packer 100 during an expansion operation with an exemplary expander tool 900 such as an inflatable device having a bladder 902 that is capable of being fluid pressurized to expand the tubing 104. For some embodiments, the expander tool 900 includes a locating mechanism 904. The locating mechanism 904 includes dogs 906 biased outward to engage recesses 908 at selected locations along an inside of the tubing 104. Mechanical engagement between the dogs 906 and each of the recesses 908 provides resistance from further relative movement of the expander tool 900 within the tubing 104. Other mechanical devices such slips or other forms of retractable grippers may be used in place of the dogs 906.

The selected locations thus identify when the expander tool 900 has been located where desired such as when moving the expander tool 900 from its position at a last expansion cycle to a subsequent length of the tubing 104 for expansion. Use of the locating mechanism 904 helps ensure that a length of the tubing 104 is not missed in the expansion process. Any missed sections may have trapped fluid that inhibits expansion of the missed sections. Attempts to later expand missed sections may force such trapped fluid to collapse surrounding sections of the tubing 104 previously expanded.

In operation, expansion of the expandable packer 100 does not require expensive high pressure pumps on a rig as a mobile pump using relatively less volume can operate the expander tool 900. The expander tool 900 also works reliably over multiple expansion cycles especially given that expansion ratios may be controlled to be less than 50%.

Figure 11A:
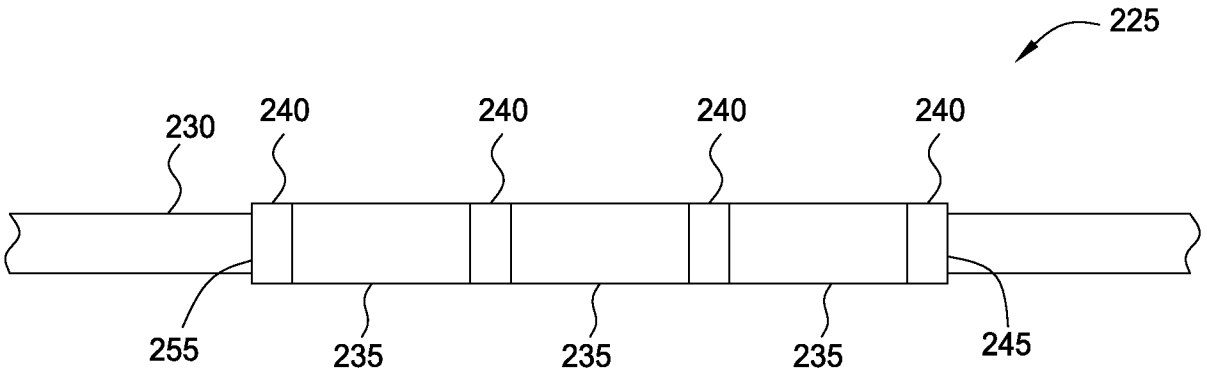
FIGS. 11A and 11B are views illustrating an expansion tool for use with the expandable packer.
Figure 11B:
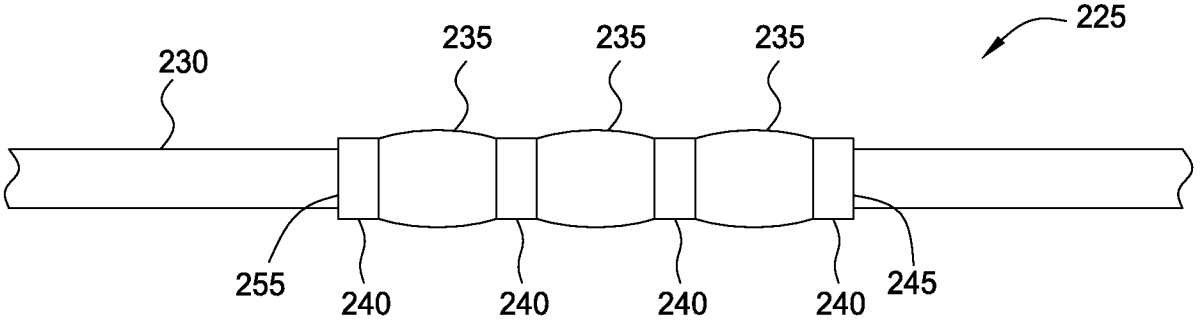

FIGS. 11A and 11B are views illustrating an expansion tool 225 for use with the expandable packer 100. The expansion tool 225 includes a mandrel 230, elastomeric sections 235 and optional spacer bands 240. Generally, the expansion tool 225 is actuated by applying an axial force to elastomeric sections 235 by a force member, such as a hydraulic jack, which causes the elastomeric sections 235 to compress and expand radially outward, as shown in FIG. 11B. In turn, the outward expansion of the elastomeric sections 235 causes a surrounding tubular to expand radially outward. It is to be noted that the bands 240 may also expand radially outward but not as much as the elastomeric sections 235. In one embodiment, a first end 245 of the expansion tool 225 is movable and a second end 255 is fixed. In this embodiment, the force is applied to the first end 245 which causes the first end 245 to move toward the second end 255, thereby compressing the elastomeric sections 235. In another embodiment, the first end 245 and the second end 255 are movable and the forces are applied to both ends 245, 255 to compress the elastomeric sections 235. In a further embodiment, the second end 255 is fixed to the mandrel 230 and the first end 245 is movable. In this embodiment, the force is applied to the first end 245 while substantially simultaneously pulling on the mandrel 230 to move the second end 255 toward the first end 245, thereby compressing the elastomeric sections 235.

The elastomeric sections 235 may be made from rubber or any other type of resilient material. The elastomeric sections 235 may be coated with a non-friction material (not shown) such as a composite material. The non-friction material is used to reduce the friction between the elastomeric sections 235 and the surrounding tubular. Further, the non-friction material may protect the elastomeric sections 235 from damage or wear which may occur due to multiple expansion operations.

The bands 240 in between the elastomeric sections 235 are used to separate elastomeric sections 235. The bands 240 may be made from any suitable material, such as thin metal, composite material or elastomeric material having a hardness that is different from the elastomeric sections 235.

Figure 12A:
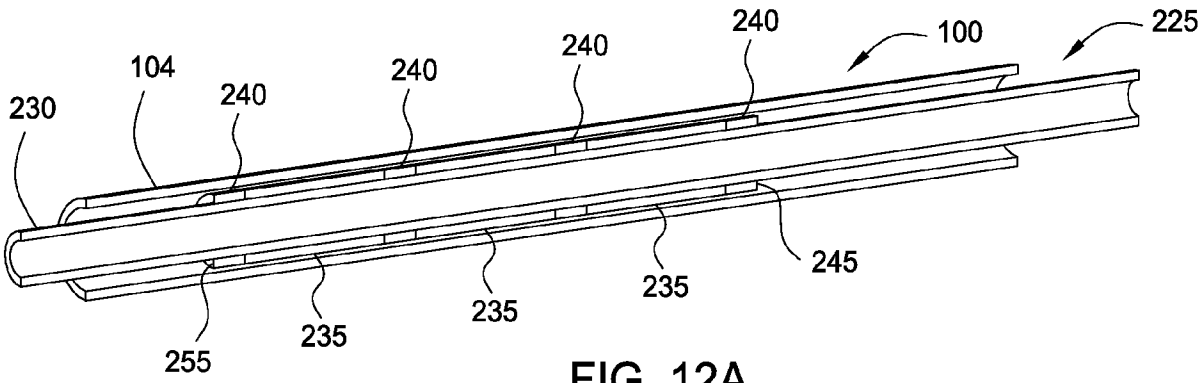
FIGS. 12A and 12B are views illustrating the expansion tool disposed in the expandable packer.
Figure 12B:
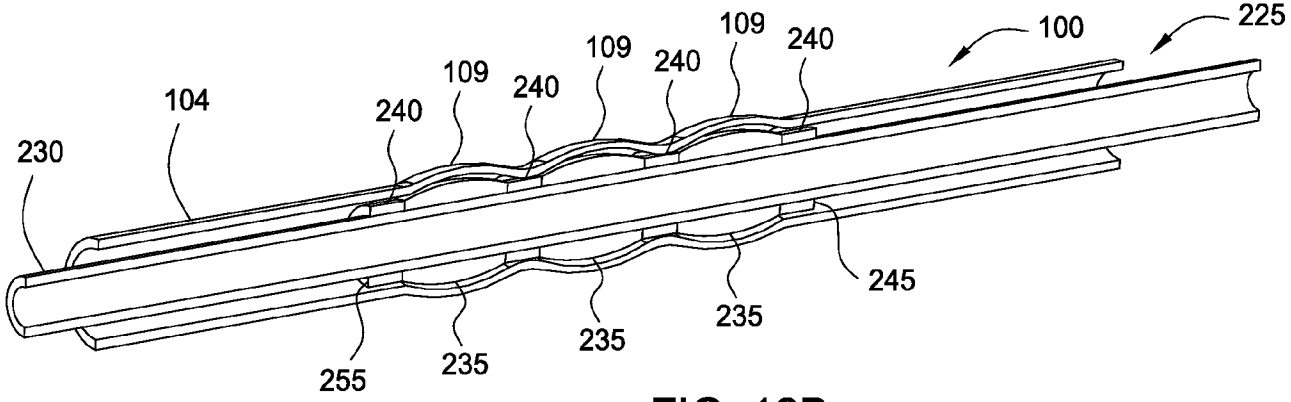

FIGS. 12A and 12B are views illustrating the expansion tool 225 disposed in the tubing 104 of the expandable packer 100. For clarity, the thick bands 106 and the thin bands 108 of the sealing material 102 are not shown. The expansion tool 225 may be used to expand the expandable packer 100 into an expanded position within a surrounding structure such as an open borehole or casing (not shown). Upon expansion, the tubing 104 is plastically deformed to selectively create the undulations 109 which result in a high pressure seal, as shown in FIG. 12B. The expansion tool 225 may be located in the expandable packer 100 in any manner. In one embodiment, the expansion tool 225 is located in the expandable packer 100 such that the elastomeric sections 235 are positioned adjacent the thin bands 108 and the bands 240 are positioned adjacent the thick bands 106. Upon activation of the expansion tool 225, the elastomeric sections 235 expand radially outward which causes the tubular 104 to plastically deform and form the undulations 109. While not expanded as much, the tubing 104 corresponding to where the thick bands 106 of the sealing material 102 are located also deforms in a radial outward direction to place the thick bands 106 into engagement with the casing. It is to be noted that the undulations 109 tend to increase collapse resistance of the tubing 104. Thus, the increase in collapse resistance benefits the sealing ability of the sealing element 102. Further, the undulations 109 at least reduce any potential decreases in seal load as a result of elastic recovery of the tubing 104 immediately after expansion. The undulations 109 may also experience less elastic recovery than when a longer length of the tubing 104 is expanded, thereby mitigating effect of the elastic recovery causing removal of the seal load.

Figure 13A:
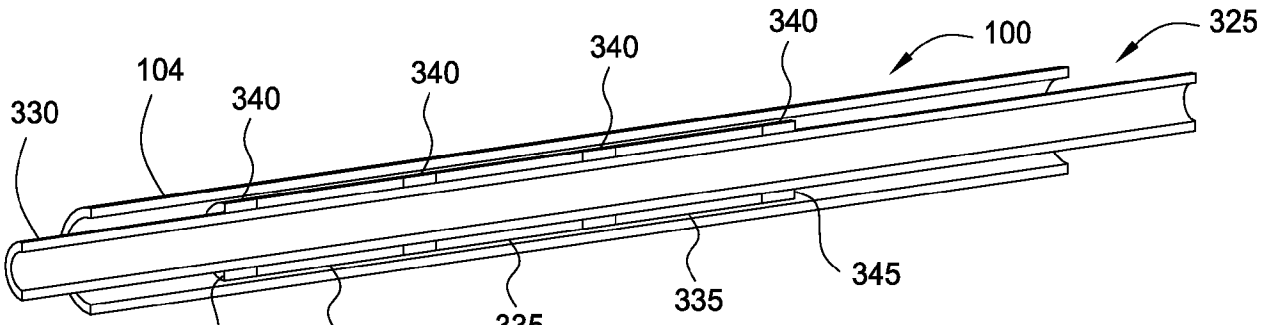
FIGS. 13A and 13B are views illustrating an expansion tool disposed in the expandable packer.
Figure 13B:
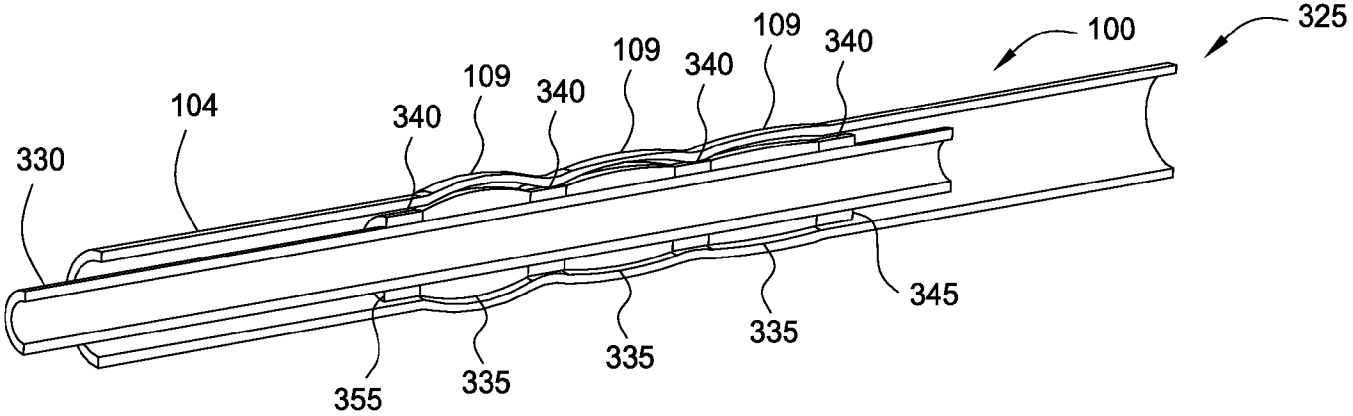

FIGS. 13A and 13B are views illustrating an expansion tool 325 disposed in the tubing 104 of the expandable packer 100. The expansion tool 325 includes a mandrel 330, elastomeric sections 335, 345, 355 and optional bands 340. The expansion tool 325 operates by applying an axial force to elastomeric sections 335, 345, 355 which causes the elastomeric sections 335, 345, 355 to compress and expand radially outward.

The expansion tool 325 may be used to expand the expandable packer 100 into an expanded position within a surrounding structure such as an open borehole or casing (not shown). For clarity, the thick bands 106 and the thin bands 108 of the sealing material 102 are not shown. As illustrated, the elastomeric sections 335, 345, 355 are tapered down (or tiered) from one end 355 to another end 345. The reducing diameter of the elastomeric sections 335, 345, 355 may be stepwise (as illustrated), or it may be a continuous reducing diameter, such as cone shaped. The taper in the elastomeric sections 335, 345, 355 may be used to drive fluid out of the annulus between the casing and the sealing material on the expandable packer 100, thereby preventing any pipe collapse due to trapped fluid expansion. The bands 340 between the elastomeric sections 335, 345, 355 are not tapered. However, in one embodiment, the bands 340 may have a taper in a similar manner as the elastomeric sections 335, 345, 355.

FIG. 13B illustrates the expansion tool 325 inside the tubing 104 during the expansion process. The first portion of the tubing 104 that is juxtaposed with the thicker elastomeric section 335 expands first and additional axial force is applied to expand the elastomeric sections 345, 355 to subsequently expand the remaining portions of the tubular 104 similar to the first portion. In other words, the expansion process along the short length of the tubular 104 is progressive. As shown, the tubing 104 is plastically deformed to selectively create the undulations 109 which result in a high pressure seal between the expandable packer 100 and the surrounding structure. It is to be noted that the resulting undulations 109 are also tapered (or tiered) similar to the elastomeric sections 335, 345, 355. The expansion tool 325 may be positioned in the expandable packer 100 in any manner. In one embodiment, the expansion tool 325 is located in the expandable packer 100 such that the elastomeric sections 335, 345, 355 are positioned adjacent the thin bands 108 and the bands 340 are positioned adjacent the thick bands 106.

Figure 14A:
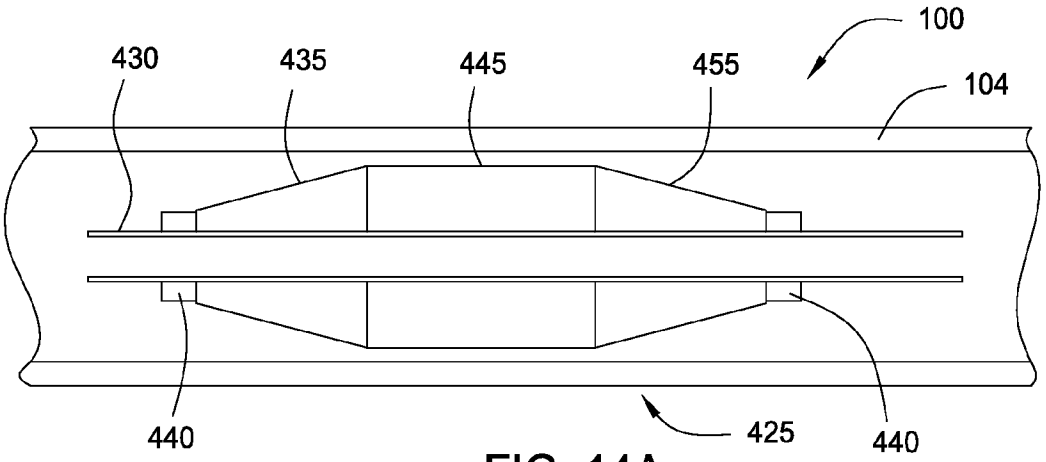
FIGS. 14A and 14B are views illustrating an expansion tool disposed in the expandable packer.
Figure 14B:
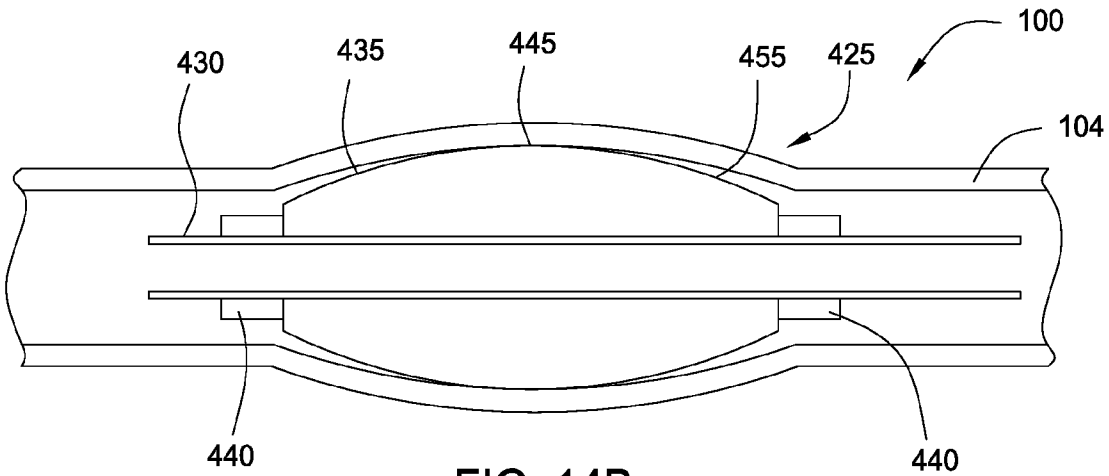

FIGS. 14A and 14B are views illustrating an expansion tool 425 disposed in the tubing 104 of the expandable packer 100. The expansion tool 425 includes a mandrel 430, elastomeric sections 435, 445, 455 and optional bands 440. The expansion tool 425 operates by applying an axial force to elastomeric sections 435, 445, 455 which causes the elastomeric sections 435, 445, 455 to compress and expand radially outward. The expansion tool 425 may be used to expand the expandable packer 100 into an expanded position within a surrounding structure. For clarity, the thick bands 106 and the thin bands 108 of the sealing material 102 are not shown. As illustrated, the elastomeric sections 435 and 455 are tapered down from the elastomeric section 445 to create a profiled shape. The way the tubular expands by utilizing the profiled shape of the elastomeric sections 435, 445, 455 will drive fluid out of the annulus between the casing and the sealing material on the expandable packer 100, thereby preventing trapped fluid expansion in the annulus. As shown in FIG. 14B, the tubing 104 plastically deforms. It is to be noted the undulations may be formed in the tubing 104 in a similar manner as set forth in FIGS. 1 and 2, thereby resulting in a high pressure sealing between the expandable packer 100 and the surrounding structure.

Figure 15A:
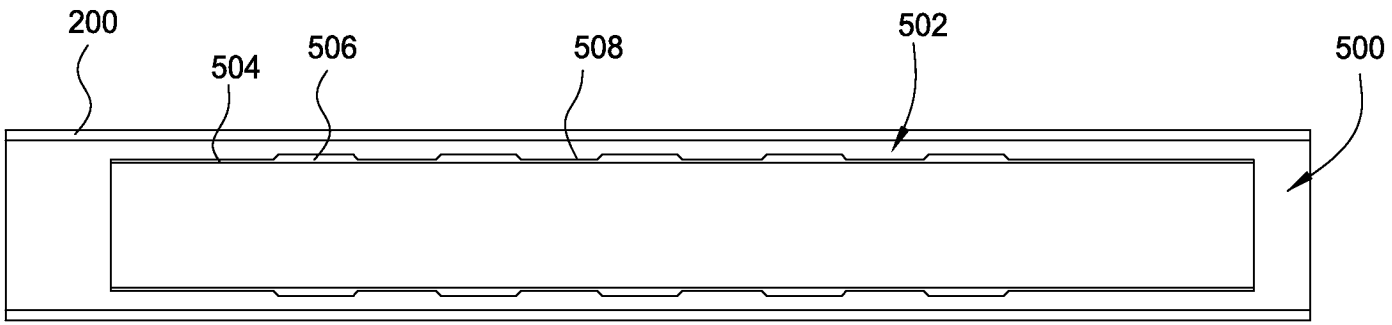
FIGS. 15A and 15B illustrate an expandable packer in a casing.
Figure 15B:
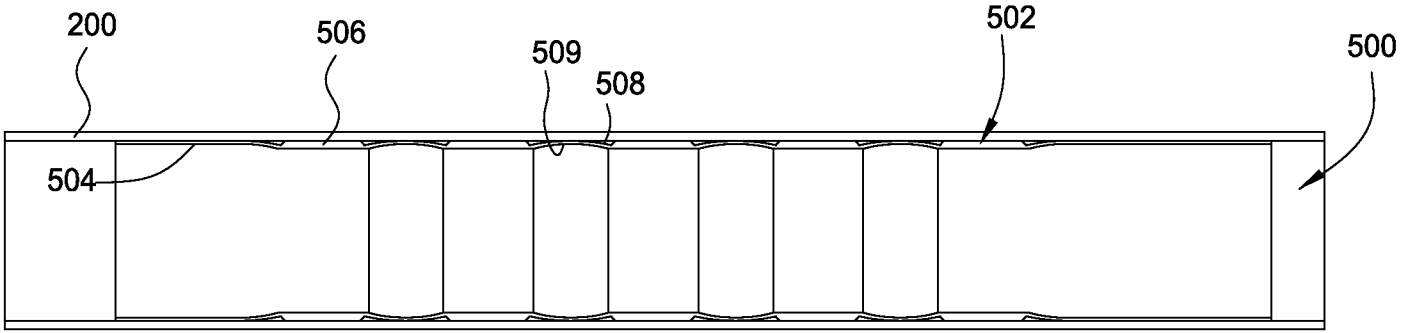
Figure 16A:
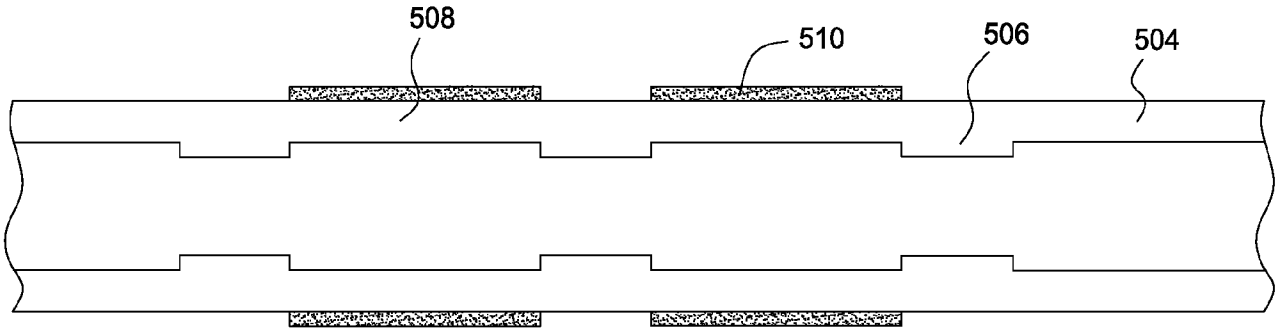
FIGS. 16A and 16B illustrate another embodiment of the expandable packer.
Figure 16B:
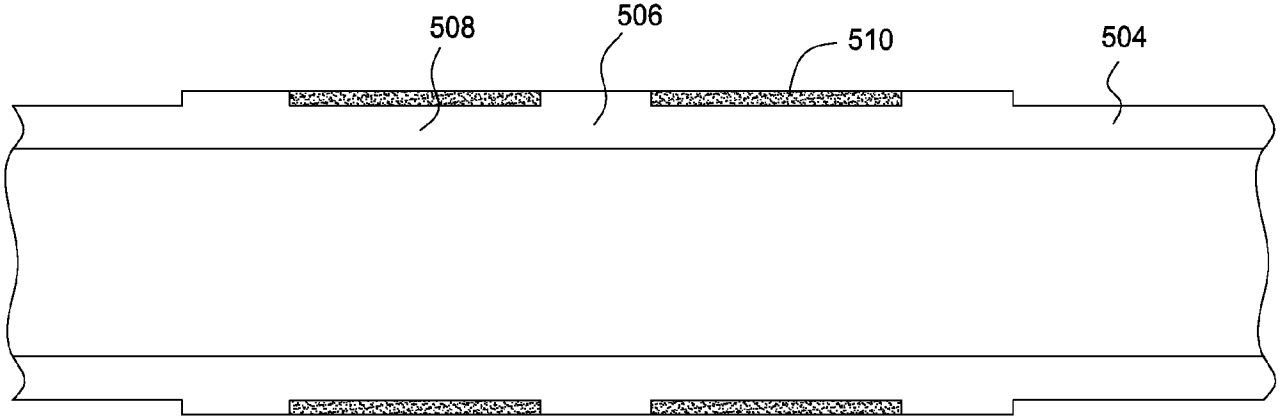
Figure 17A:
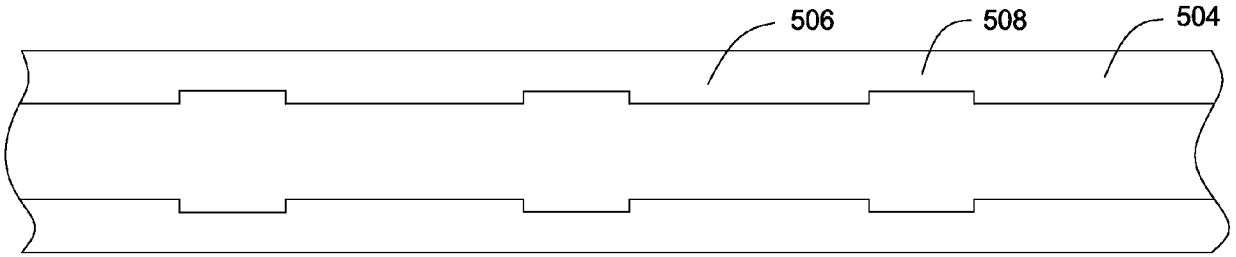
FIGS. 17A and 17B illustrate another embodiment of the expandable packer.
Figure 17B:
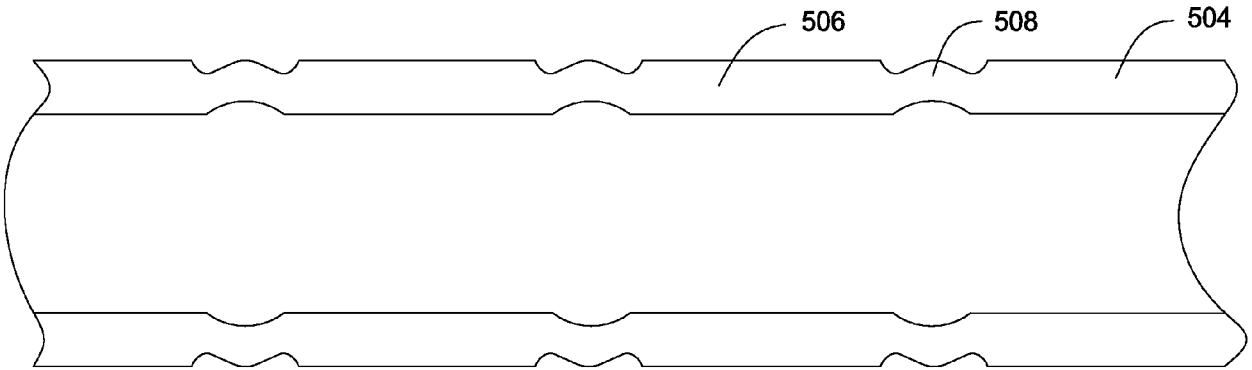

FIGS. 15A and 15B illustrate an expandable packer 500 in the casing 200. The expandable packer 500 includes a profiled sealing material 502 disposed on an outside surface of a base tubing 504. The sealing material 502 may be the same material as the material of the base tubing 504. For instance, a portion of the wall of the base tubing 504 may be cut to form the sealing material 502. The wall of the base tubing 504 may be machined on a portion of the outer diameter and/or a portion of the inner diameter. FIG. 16A illustrates a portion of the inner diameter of the tubing 504 having been machined to form thick bands 506 and thin bands 508. Additionally, optional elastomeric elements 510 may be placed around an outer surface of the tubing 508. FIG. 16B illustrates the tubing 504 shown in FIG. 16A after expansion. FIG. 17A illustrates a portion of the inner diameter of the tubing 504 having been machined to form thick bands 506 and thin bands 508. FIG. 17B illustrates the tubing 504 shown in FIG. 17A after expansion.

Returning back to FIG. 15A, in another embodiment, the sealing material 502 may be different material placed around the tubing 504, such as a soft metal with low yield strength, high malleability and ductility. Along this length of the tubing 504 where the sealing material 502 extends, a property (e.g., thickness, compressibility, or hardness) of the sealing material 502 may vary to achieve desired expansion results. As illustrated, the sealing material 502 defines a topography that alternates lengthwise over the tubing 504 between thick bands 506 of the sealing material 502 that occupy a greater annular area than thin bands 508 of the sealing material 502. Each of the bands 506, 508 circumscribe the tubing 504 to form a ring shape oriented transverse to a longitudinal bore of the tubing 504. The expandable packer 500 may utilize any number of the bands 506, 508 and in some embodiments has at least one of the thick bands 506 disposed between two of the thin bands 508. Additionally, in some embodiments, a grit (not shown) or other grip enhancing formations, such as slips, may be disposed on the outside of the tubing 504, as set forth herein.

FIG. 15B shows the expandable packer 500 in an expanded position within a surrounding structure such as an open borehole or casing 200. Upon expansion, the tubing 504 plastically deforms selectively creating undulations 509 resulting in high pressure sealing. The undulations 509 occur as a result of and where the thin bands 508 of the sealing material 502 permit relatively greater radial expansion of the tubing 504. While not expanded as much, the tubing 504 corresponding to where the thick bands 506 of the sealing material 502 are located also deforms in a radial outward direction to place the thick bands 506 into engagement with the casing 200. In this manner, a metal to metal seal may be generated and retained due to residual plastic strain on the tubing 504. It should be noted that the casing 200 may also be deformed elastically to enhance the metal to metal seals. Further, it should be noted that the undulations 509 tend to increase collapse resistance of the tubing 504 which benefits the sealing ability of the sealing element 502. In another embodiment, the seal between the expandable packer 500 and the casing 200 may be a combination of metal to metal and elastomeric seals.

It is also to be noted that the expansion tools 225, 325, 425 may be used to form the undulations in the expandable packer 100, 500. In addition, the expansion tools 225, 325, 425 may be used to form undulations in other types of tubulars, such as plain pipe with or without sealing elastomers.

For some embodiments, the expandable packer provides a straddle packer, a liner hanger packer, a bridge plug, a scab liner, a zonal isolation unit or a tie back shoe. The expandable packer enables hanging of liners while providing high pressure sealing. The grit or slips of the expandable packer enhance anchoring capability and may be coated on part of the tubing separate from the sealing element. Further, in any embodiment, the sealing material may be a swellable elastomeric material.

In a further embodiment, a force member may be used to place the tubing of the expandable packer in a compressive state prior to expansion of the expandable packer by placing the tubing in axial compression. While the tubing is in the compressive state, the expandable packer may be expanded such that the tubing plastically deforms to selectively create the undulations as set forth herein. An example of axial compression enhanced tubular expansion is described in US Patent Publication No. 2007/0000664, which is herein incorporated by reference.

Figure 18:
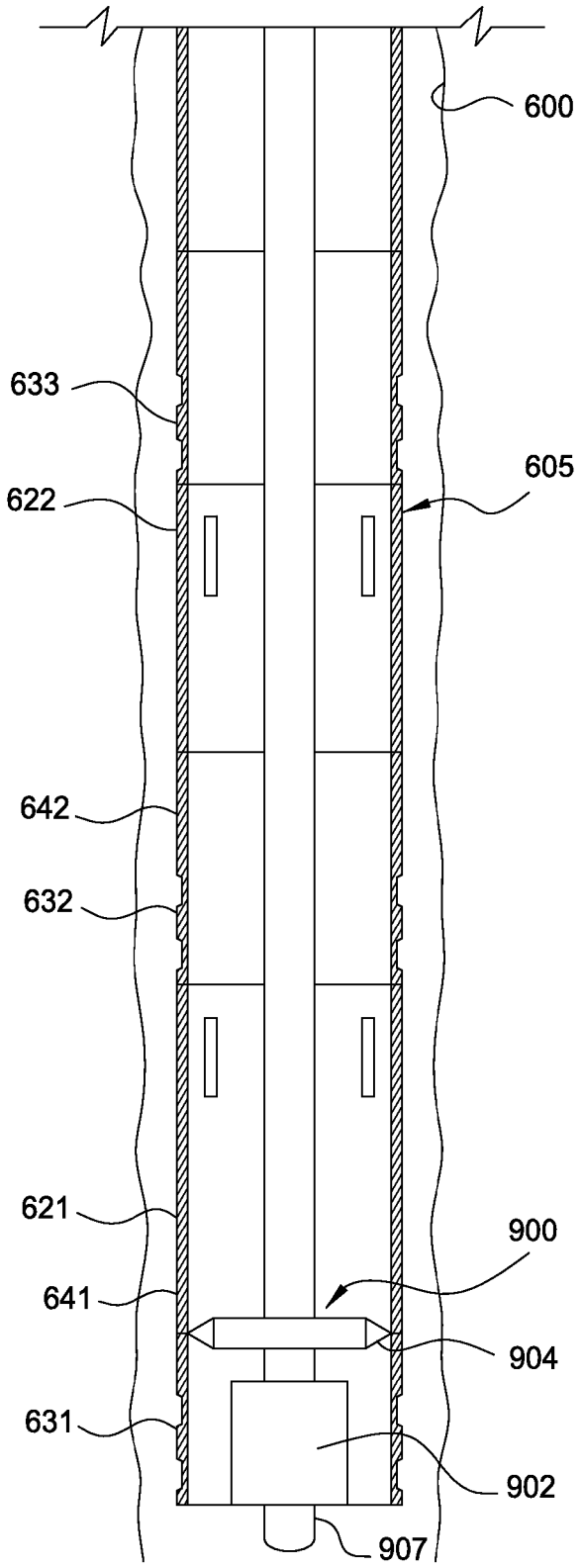
FIG. 18 illustrates a tubular string have a plurality of expandable packers for isolating multiple zones in a wellbore.

Embodiments of the expandable packer may be used to isolate multiple zones in a wellbore. FIG. 18 illustrates a tubular string 605 positioned in an open hole section of the wellbore 600. The tubular string 605 includes a plurality of expandable packers 631-633 disposed between tubular sections 621, 622 having one or more openings for fluid communication. Exemplary openings include slots, holes, and selectively operable openings such as a sliding sleeve valve. The tubular string 605 may also include solid tubular sections 641-642. It must be noted that the tubular string 605 may also be used in a cased wellbore section.

In one embodiment, the expandable packer 631 includes a tubing having a non-uniform outer profile. In this respect, the tubing may be machined to have different outer diameter portions. For example, the tubing may have reduced outer diameter portions disposed between unchanged outer diameter portions. In one example, the tubing may be formed to have a profile similar to the expandable packer 500 shown in FIG. 15A. The plurality of expandable packers 631-633 may have the same or different profiles.

An optional sealing material may be disposed on the exterior of the expandable packers 631-633. The sealing material may be selected based on its ability to withstand high pressure or high temperature conditions. An exemplary sealing material is carbon fiber. In another embodiment, the sealing material may be a metal o-ring. In non-high pressure, high temperature environments, the sealing material may be selected from hard, soft, or swellable elastomers. The sealing material may be disposed on the unchanged diameter portions, the reduced diameter portions, or both.

Figure 18A:
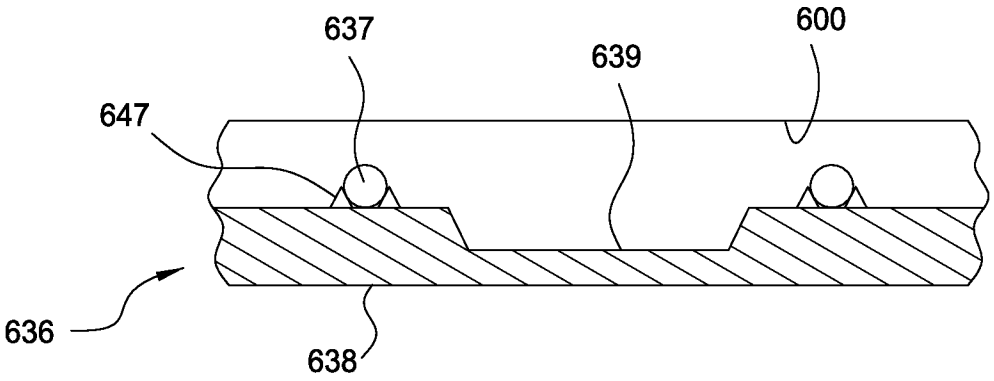
FIGS. 18A and 18B illustrate an exemplary embodiment of an expandable packer before and after expansion, respectively.
Figure 18B:
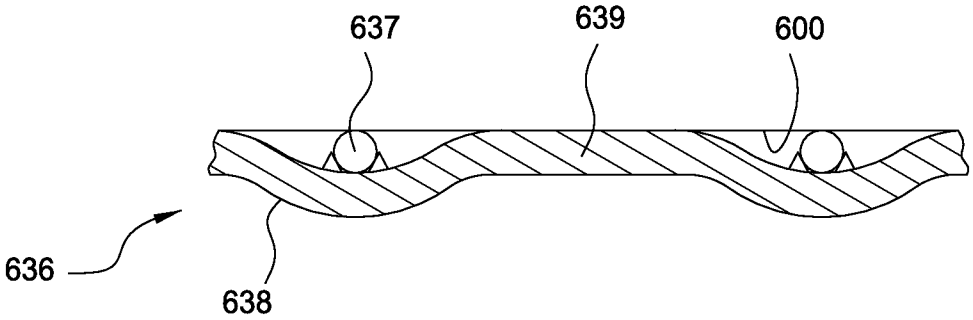

FIG. 18*a* illustrates a partial view of an exemplary expandable packer 636 having the metal o-rings 637 disposed spaced apart on an expandable tubing section 638. As shown, the metal o-rings 637 are disposed on an unchanged diameter portion, and the tubing section 639 between the metal o-rings 637 may be a reduced diameter section (as shown) or an unchanged diameter portion. In another embodiment, one or more metal o-rings 637 may be disposed on an unchanged diameter portion, reduced diameter portion, or combinations thereof. The metal o-rings 637 may be supported on each side using a protruding member 647. FIG. 18*b* illustrates the expandable packer 636 after expansion. It can be seen that the tubular section 639 has been expanded to form an undulation between the two spaced apart metal o-rings 637 and to seal against the wellbore 600.

The expandable packers 631-633 may be expanded using one of the expander tools described herein. For example, the expandable packers 631-633 may be expanded using the expander tool 900 having an inflatable device described with reference to FIG. 10. The expander tool 900 may include the locating mechanism 904 to facilitate movement to other expandable packers during operation. The expandable packers may also be expanded using a hydraulic jack or a direct or indirect hydroform process. In one embodiment, the expander tool is configured to apply a radial force to expand the expandable packers.

Figure 19:
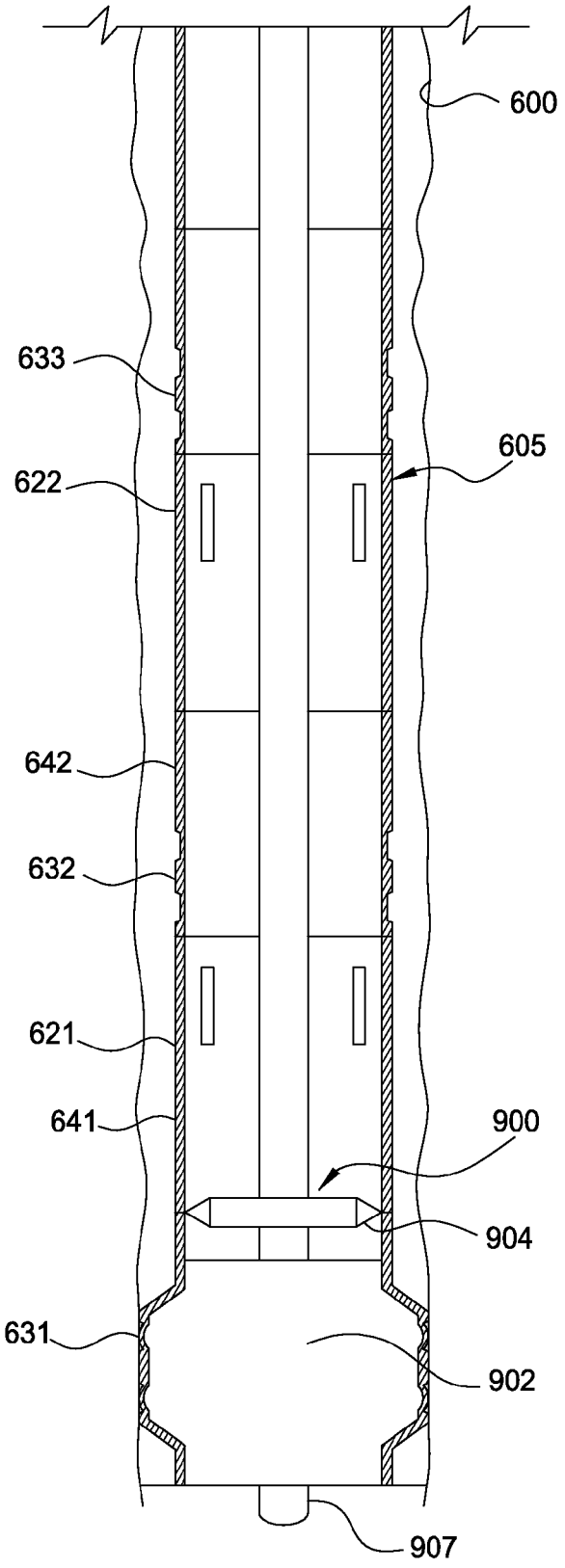
FIG. 19 illustrates the tubular string of FIG. 18 after expansion of one of the expandable packers.

The tubular string 605 may be used in an artificial lift application. The tubular string 605 may be used to inject steam or other fluids into isolated sections of the wellbore 600. In one embodiment, the wellbore 600 has an 8.5 inch open hole diameter, and the tubular string 605 has a 7 inch diameter. During operation, the expander tool 900 is positioned inside the tubular string 605 adjacent the lowest expandable packer 631. The locating mechanism 904 is engaged to a recess in the tubular string 605. A ball is released from the surface and lands in a valve 907 below the bladder 902 of the expander tool 900, thereby closing off the bore to allow pressure to increase. Inflation of the bladder 902 applies a radial force to the packer 631 to cause expansion of the expandable packer 631 toward the wellbore wall. Upon expansion, the tubing 605 of the expandable packer 631 is plastically deformed to selectively create undulations which results in a seal formed with the wellbore wall, as shown in FIG. 19. The expanded profile of the expandable packer 631 may look similar to the expanded profile shown in FIG. 15B. The non-unform profile 775 may include an unchanged diameter section disposed between two reduced diameter sections. Upon expansion, at least a portion of the reduced diameter sections and the unchanged diameter section are expanded. As shown, the unchanged diameter section located between the two reduced diameter sections are expanded along with the reduced diameter sections. It must be noted the non-uniform profile 775 may include any suitable arrangement and number of reduced and unchanged diameter sections. The undulations created from the non-uniform outer profile of the tubing 605 may reduce any potential decreases in seal load as a result of elastic recovery of the tubing 605 immediately after expansion. The undulations may experience less elastic recovery than when a longer length of the tubing is expanded, thereby mitigating effect of the elastic recovery causing removal of the seal load.

Figure 20:
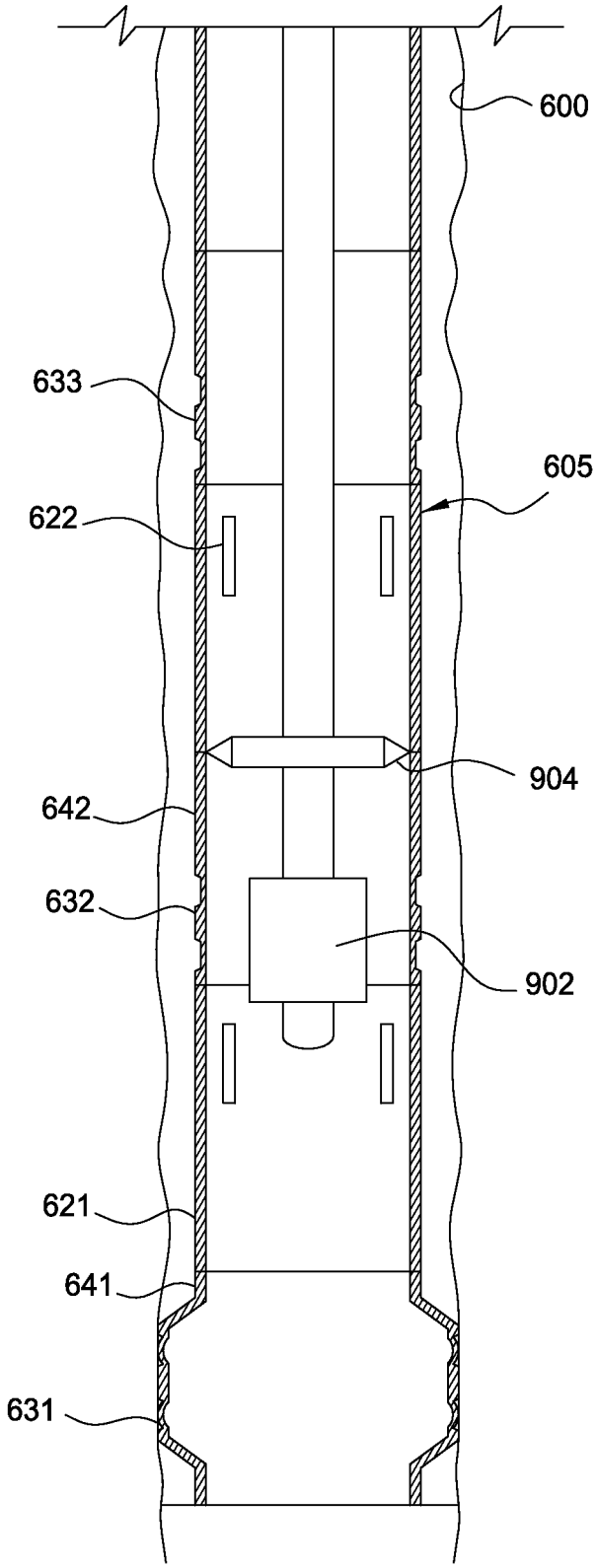
FIG. 20 illustrates the tubular string of FIG. 18 prior to expansion of a second expandable packer.
Figure 21:
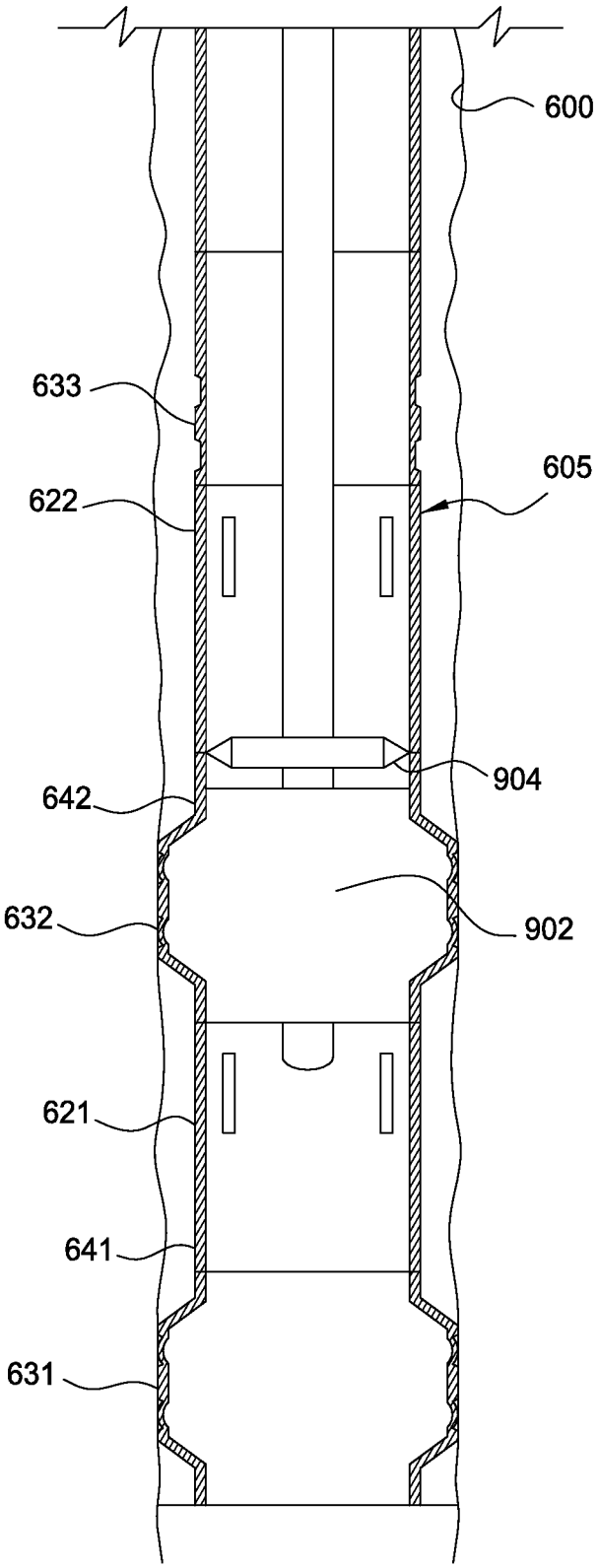
FIG. 21 illustrates the tubular string of FIG. 18 after expansion of two of the expandable packers.
Figure 22:
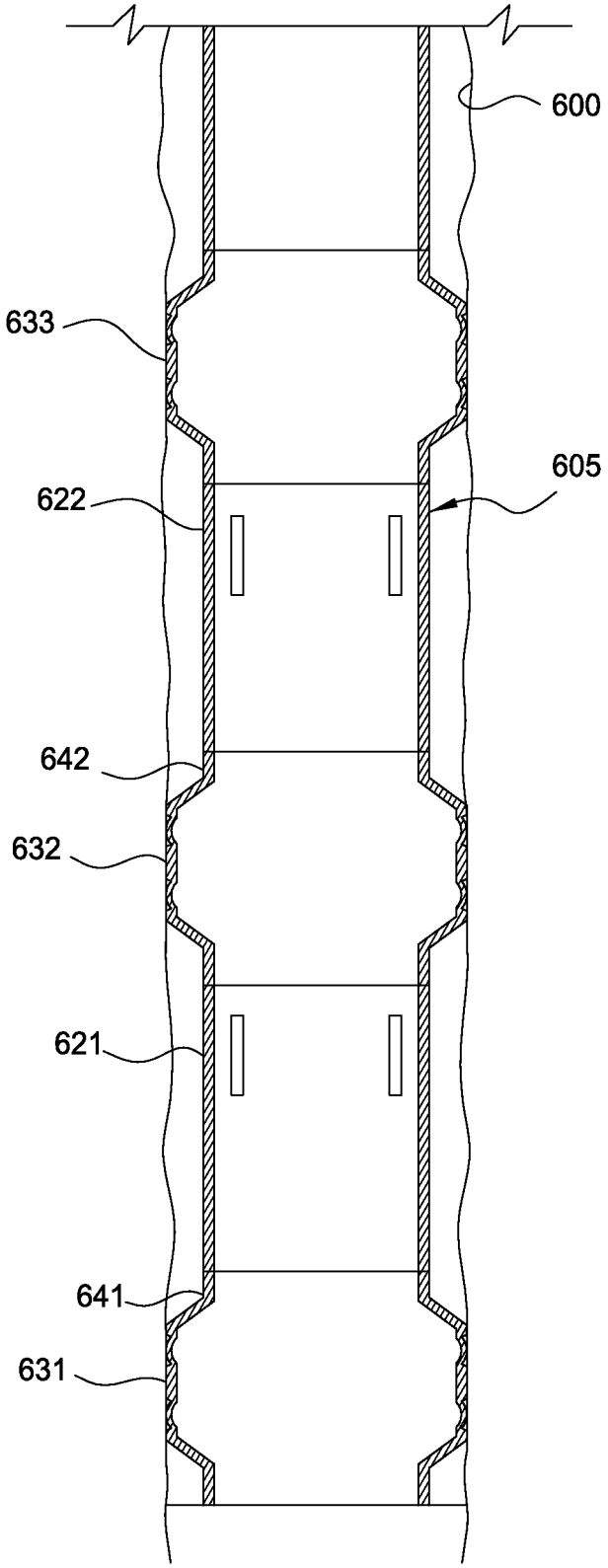
FIG. 22 illustrates the tubular string of FIG. 18 after expansion.
Figure 23:
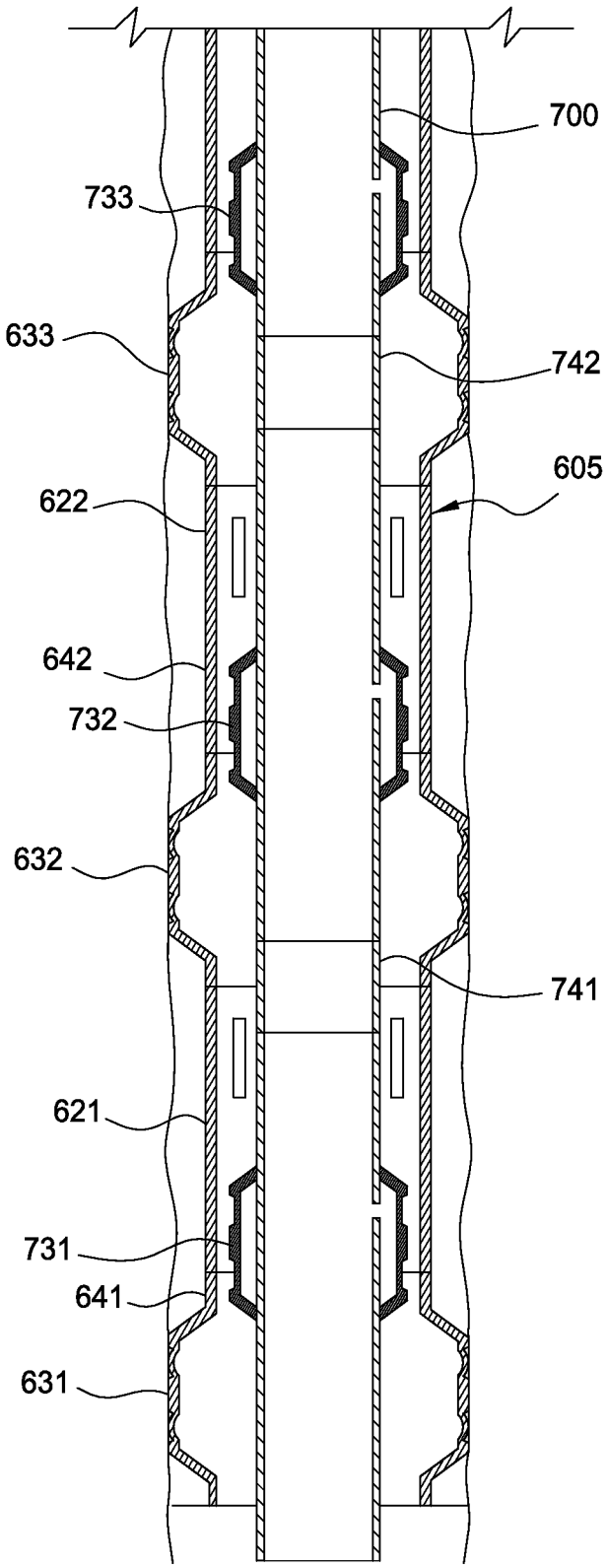
FIG. 23 illustrates a production tubular configured to isolate multiple zones in the tubular string of FIG. 22.

After expansion, the pressure in the bladder 902 is relieved, and the expander tool 900 is moved to the next expandable packer 632, as shown in FIG. 20. The locating mechanism 904 is used to guide the move to the next expandable packer 632. After the proper position is located, the expander tool 900 is activated to expand the expandable packer 632. FIG. 21 shows the second expandable packer 632 being expanded by the expander tool 900. This process may be repeated until all of the packers have been expanded. FIG. 22 shows the tubular string after the expandable packers 631-633 have been activated. In this manner, the expandable packers 631-633 may be activated to isolate multiple zones targeted for steam injection. The steam may be supplied through the slots in the slotted tubular sections 621, 622. In addition, because elastomers are not used in this application, the expandable packers may be used in high temperature, high pressure environments. Optionally, other portions of the tubular string 605 may be at least partially expanded. For example, any of the slotted tubular sections 621, 622 and solid tubular sections 641, 642 may be expanded. These sections may be expanded to a diameter that is smaller or substantially the same size as the expanded packer 631-633 diameter.

After isolation of the zones, an inner tubular such as a production tubular 700 may be positioned inside the tubular string 605 to collect and transport hydrocarbon or other fluids in the wellbore. The production tubular 700 may include a plurality of expandable packers 731-733 for isolating zones in the tubular string 605. The expandable packers 731-733 may be expanded against solid, unexpanded sections 641, 642 of the tubular string 605. Optionally, the production tubular 700 may be at least partially expanded. In one example, the production tubular 700 is expanded to a diameter smaller than the unexpanded diameter of the expandable packer 731. In one embodiment, expandable packer 731-733 may be selected from any suitable expandable packer described herein. For example, the expandable packer may have a non-uniform outer diameter profile. In one embodiment, the production tubular 700 may include one or more opening for fluid communication with the exterior. In another embodiment, fluid may enter the production tubular 700 through one or more valve sleeves 741, 742 that are selectively operable.

In some instances, the production tubular 700 may require expansion to a diameter that adversely affects the integrity of the seal formed. For example, the production tubular 700 may have a 5 inch diameter while the tubular string has a 7 inch diameter. In this example, the resulting seal may be ineffective due to the extent of expansion.

Figure 24:
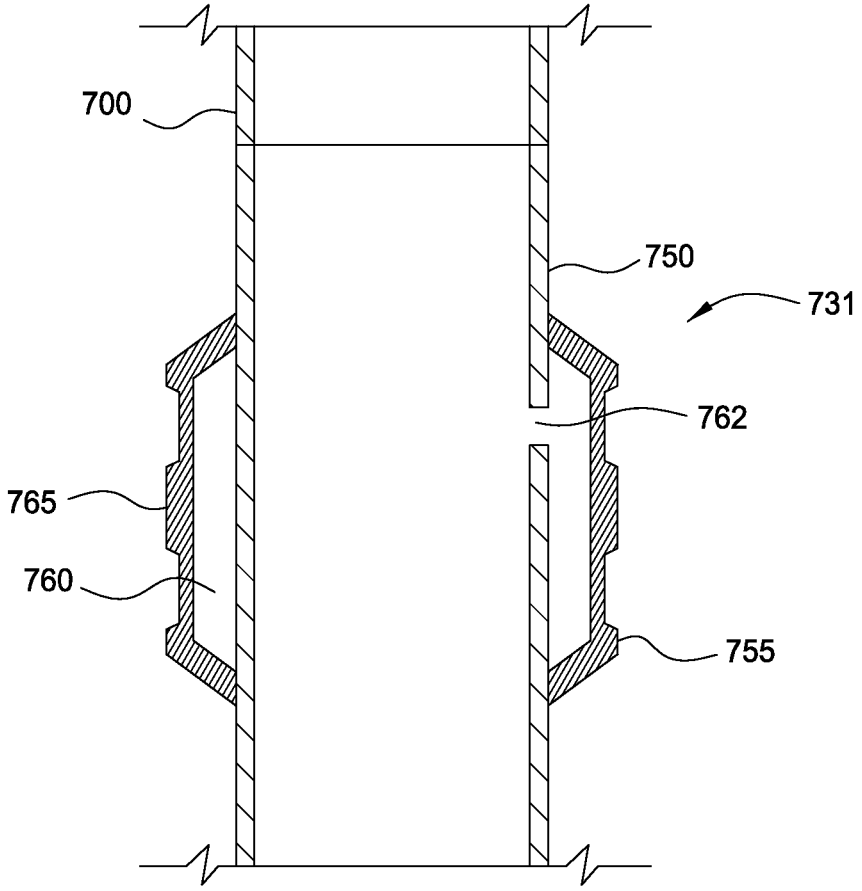
FIG. 24 illustrates an exemplary embodiment of an expandable packer having an enlarged outer diameter.

In one embodiment, an exemplary expandable packer 731 may include a tubing 750 and an outer tubular 755 attached to the tubing 750. FIG. 24 is an enlarged view of the expandable packer 731. The tubing 750 may be connected to the production tubular 700. The ends of the outer tubular 755 may be attached to the tubing 750 to form an annular area 760 therebetween. For example, the outer tubular 755 may be welded to the tubing 750. The outer diameter of the outer tubular 755 is larger than the outer diameter of the production tubular 700. The size of the outer tubular 755 may be selected based on the amount of expansion necessary to achieve an effective seal. The tubing 750 may include one or more ports 762 for fluid communication with the annular area 760. Fluid may be supplied into the annular 760 area to expand the outer tubular 755 into contact with the tubular string 605, thereby forming a seal. The outer tubular 755 may have a non-uniform outer profile 765 such that undulations may be formed upon expansion. The non-unform profile 765 may include a reduced diameter section and an unchanged diameter section. Upon expansion, at least a portion of the reduced diameter section and the unchanged diameter section is expanded. Optionally, the tubing 750 may be at least partially expanded. For example, the tubing 750 may expanded to a diameter that is larger or smaller than the unexpanded diameter of the expandable packer 731. The non-uniform outer profile 765 may be formed by machining, adding a sealing material, or combinations thereof. As shown, a plurality of reduced diameter portions are machined onto the outer surface of the outer tubular 755.

Figure 25:
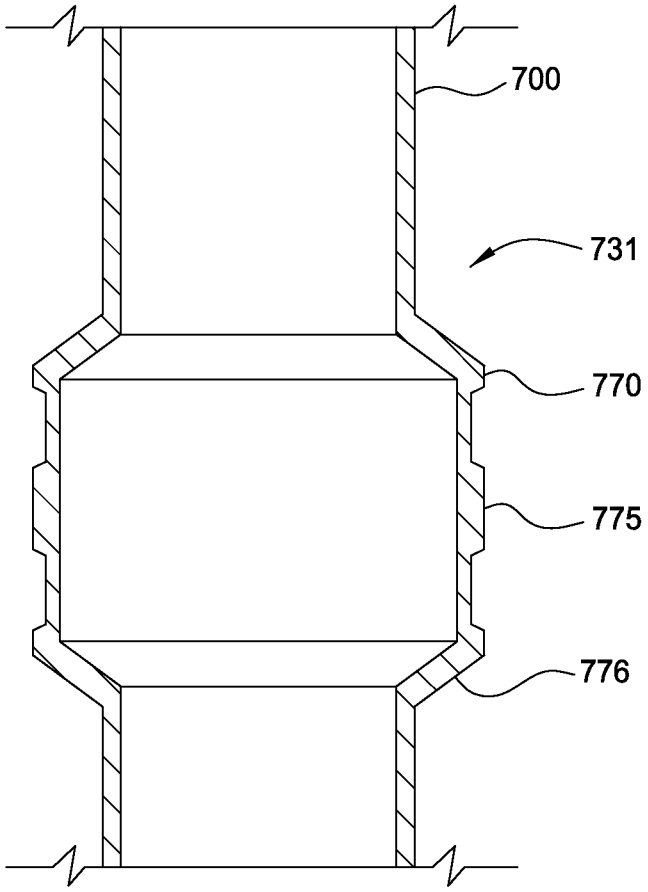
FIG. 25 illustrates another exemplary embodiment of an expandable packer having an enlarged outer diameter.

In another embodiment, a larger diameter expandable packer 770 may be connected to the production tubular 700, as shown in FIG. 25. An optional cross-over tubular 776 may be used to accommodate the change in diameter size from the expandable packer 770 to the production tubular 700. In another embodiment, the expandable packer 776 is integrally formed with the production tubular 700. The expandable packer 770 may be sized to provide an effective seal with the surrounding tubular such as the tubular string 605. The expandable packer 770 may have a non-uniform outer profile 775 such that undulations may be formed upon expansion. The non-uniform outer profile may be formed by machining, adding a sealing material, or combinations thereof. As shown, a plurality of reduced diameter portions are machined onto the outer surface of the expandable packer 770. The non-uniform profile 775 may include a reduced diameter section and an unchanged diameter section. Upon expansion, at least a portion of the reduced diameter section and the unchanged diameter section is expanded. As shown, the unchanged diameter section located between the two reduced diameter sections are expanded along with the reduced diameter sections. Optionally, the tubing 750 may be at least partially expanded. For example, the tubing 750 may expanded to a diameter that is larger or smaller than the unexpanded diameter of the expandable packer 731. The expandable packer 770 may be expanded using any suitable expander tool such as those described herein. For example, the expandable packer 770 may be expanded using an inflatable device, a hydraulic jack, hydroforming, or other suitable expansion process. In one embodiment, the expander tool applies a radial force to cause radial expansion of the packer 770.

Figure 26:
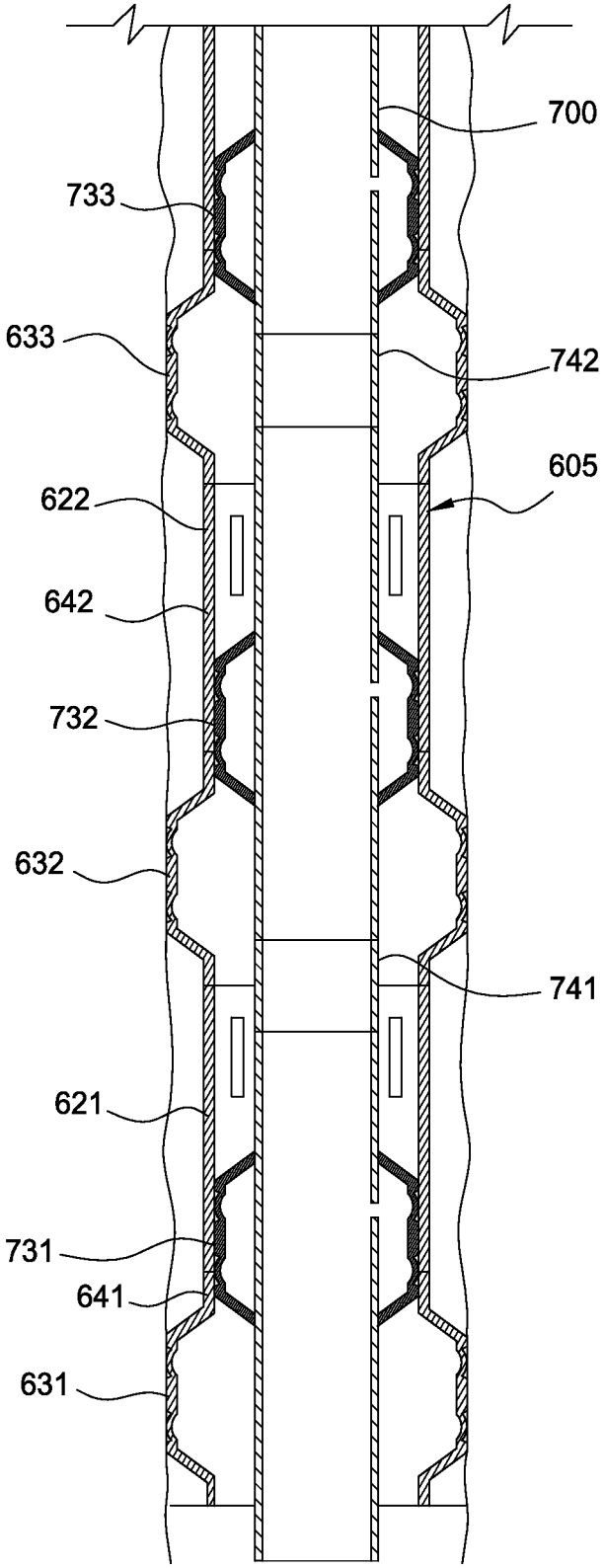
FIG. 26 illustrates the production tubular of FIG. 23 after expansion in the tubular string of FIG. 22.

The expandable packers 731-733 may be positioned adjacent unexpanded, solid sections 641, 642 of the tubular string 605. FIG. 26 shows the expandable packers 731-733 expanded against the tubular string 605. In another embodiment, the solid sections 641, 642 of the tubular string 605 may be at least partially expanded prior to receiving he expandable packers 731-733. The expandable packers have the configuration shown in FIG. 24. The expanded packers 731-733 form a seal with the tubular string 605 to isolate the slotted tubular sections 621, 622. In this manner, the slotted tubular sections may be selective operated to inject fluids into or produce fluids from the wellbore 600.

In one embodiment, an expandable apparatus includes a tubular; and an expandable packer attached to the tubular, wherein the expandable packer has an inner diameter larger than an outer diameter of the tubular and has a non-uniform outer surface, whereby upon expansion of the expandable packer, undulations are created based on the non-uniform outer surface.

In one or more of the embodiments described herein, the tubular extends through the expandable packer and the expandable packer is attached to an outer surface of the tubular.

In one or more of the embodiments described herein, the tubular includes a port for fluid communication between a bore of the tubular and an annular area formed between the tubular and the expandable packer.

In one or more of the embodiments described herein, an optional cross-over tubular is provided for connecting the expandable packer to the tubular.

In one or more of the embodiments described herein, a plurality of expandable packers are attached to the tubular.

In one or more of the embodiments described herein, the non-uniform outer surface includes a reduced diameter section and an unchanged diameter section.

In one or more of the embodiments described herein, a sealing element is disposed on an unchanged diameter section.

In one or more of the embodiments described herein, the non-uniform outer surface includes a first sealing element at a first height and a second sealing element at a second height.

In one or more of the embodiments described herein, a second tubular is disposed around the first tubular, wherein the second tubular includes a second non-uniform outer surface, whereby upon expansion of the second tubular, undulations are created based on the second non-uniform outer surface In another embodiment, a method of isolating multiple zones in a tubular includes providing an inner tubular having a plurality of expandable packers, wherein the expandable packers have an inner diameter larger than an outer diameter of the inner tubular and have a non-uniform outer surface; positioning the plurality of expandable packers inside the tubular adjacent the zones for isolation; and expanding the plurality of expandable packers into engagement with the tubular; thereby creating undulations in the plurality of expandable packers based on the non-uniform outer surface the expandable packers.

In one or more of the embodiments described herein, the inner tubular extends through at least one of the plurality of expandable packers and the at least one expandable packer is attached to an outer surface of the inner tubular.

In one or more of the embodiments described herein, the inner tubular includes a port for fluid communication between a bore of the inner tubular and an annular area formed between the inner tubular and the at least one expandable packer.

In one or more of the embodiments described herein, an optional cross-over tubular is provided for connecting the expandable packer to the inner tubular.

In one or more of the embodiments described herein, expanding the plurality of expandable packers comprises applying a radial force to the plurality of expandable packers.

In one or more of the embodiments described herein, a portion of the inner tubular is expanded.

In yet another embodiment, a method of isolating multiple zones in a wellbore includes providing a tubular string having a plurality of expandable packers, wherein each of the plurality of expandable packers include a tubing having a non-uniform outer surface; positioning the plurality of expandable packers adjacent the zones for isolation; and expanding the tubing into engagement with the wellbore; thereby creating undulations in the tubing based on the non-uniform outer diameter of the tubing.

In one or more of the embodiments described herein, a sealing element is disposed on the unchanged outer diameter section of the tubing.

In one or more of the embodiments described herein, the reduced outer diameter section is formed by machining.

In one or more of the embodiments described herein, the method includes positioning a production tubular in the tubular string, the production tubular having a plurality of expandable production packers; and expanding the plurality of expandable production packers of the production tubular against the tubular string.

In one or more of the embodiments described herein, the expandable production packers of the production tubular are expanded against a non-expanded, solid section of the tubular string.

In one or more of the embodiments described herein, the tubular string includes a slotted tubular.

In another embodiment, a method of isolating multiple zones in a wellbore includes providing a tubular string having a plurality of expandable packers, wherein each of the plurality of expandable packers include a tubing have a sealing element and the sealing element includes a non-uniform outer diameter; positioning the plurality of expandable packers adjacent the zones for isolation; and expanding the sealing element into engagement with the wellbore; thereby creating undulations in a diameter of the tubing based on the non-uniform outer diameter of the sealing element along a length of the tubing.

In one or more of the embodiments described herein, the non-uniform outer diameter includes alternating unchanged outer diameter section and reduced outer diameter sections.

While the foregoing is directed to embodiments of the present invention, other and further embodiments of the invention may be devised without departing from the basic scope thereof, and the scope thereof is determined by the claims that follow.

What is claimed is:

1. An expandable apparatus, comprising:

a tubular having a first outer diameter; and an expandable packer attached to the tubular, wherein the expandable packer comprises an outer tubular having an inner diameter larger than the first outer diameter, a packer outer diameter, and a non-uniform outer profile, the non-uniform outer profile has a reduced packer outer diameter section between packer outer diameter sections, whereby upon expansion of the expandable packer, undulations are created on the outer tubular based on the non-uniform outer profile.

2. The expandable apparatus of claim 1, wherein the tubular extends through the expandable packer and the expandable packer is attached to an outer surface of the tubular.

3. The expandable apparatus of claim 2, wherein the tubular includes a port for fluid communication between a bore of the tubular and an annular area formed between the tubular and the expanable packer.

4. The expandable apparatus of claim 1, further comprising a cross-over tubular for connecting the expandable packer to the tubular.

5. The expandable apparatus of claim 1, wherein a plurality of expandable packers are attached to the tubular.

6. The expandable apparatus of claim 1, further comprising a sealing element disposed on one of the packer outer diameter sections.

7. The expandable apparatus of claim 1, wherein the non-uniform outer profile includes a first sealing element at a first height and a second sealing element at a second height.

8. The expandable apparatus of claim 1, further comprising a second tubular disposed around the first tubular, wherein the second tubular includes a second non-uniform outer profile, whereby upon expansion of the second tubular, undulations are created based on the second non-uniform outer profile.

9. A method of isolating multiple zones in a tubular, comprising:

providing an inner tubular having a plurality of expandable packers, wherein the expandable packers have an inner diameter larger than an outer diameter of the inner tubular, a packer outer diameter, and a non-uniform outer profile, the non-uniform outer profile has a reduced packer outer diameter section between packer outer diameter sections;

positioning the plurality of expandable packers inside the tubular adjacent the zones for isolation; and expanding the plurality of expandable packers into engagement with the tubular; thereby creating undulations in the plurality of expandable packers based on the non-uniform outer profile.

10. The method of claim 9, wherein the inner tubular extends through at least one of the plurality of expandable packers and the at least one expandable packer is attached to an outer surface of the inner tubular.

11. The method of claim 10, wherein the inner tubular includes a port for fluid communication between a bore of the inner tubular and an annular area formed between the inner tubular and the at least one expanable packer.

12. The method of claim 9, further comprising a cross-over tubular for connecting the expandable packer to the inner tubular.

13. The method of claim 9, wherein expanding the plurality of expandable packers comprises applying a radial force to the plurality of expandable packers.

14. The method of claim 9, further comprising expanding a portion of the inner tubular.

15. A method of isolating multiple zones in a wellbore, comprising:

providing a tubular string having a plurality of expandable packers, wherein each of the plurality of expandable packers include a tubing portion having a non-uniform outer surface;

positioning the plurality of expandable packers adjacent the zones for isolation;

expanding the tubing portion into engagement with the wellbore; thereby creating undulations in the tubing portion based on the non-uniform outer surface of the tubing portion;

positioning a production tubular in the tubular string, the production tubular having a plurality of expandable production packers; and expanding the plurality of expandable production packers of the production tubular against the tubular string.

16. The method of claim 15, wherein the non-uniform outer surface includes a reduced outer diameter section and an unchanged outer diameter section.

17. The method of claim 16, further comprising disposing a sealing element on the unchanged outer diameter section of the tubing portion.

18. The method of claim 16, wherein the reduced outer diameter section is formed by machining.

19. The method of claim 15, wherein the expandable production packers of the production tubular are expanded against a non-expanded, solid section of the tubular string.

20. The method of claim 15, wherein each of the production packers comprises an outer tubular attached to the production tubular, and expanding the plurality of expandable production packers comprises expanding a portion of the production tubular.

21. The method of claim 15, wherein the tubular string includes a slotted tubular.

22. The method of claim 15, wherein the tubing portion is attached to an outer diameter of the tubular string, and expanding the plurality of expandable packers comprises further comprising expanding a portion of the tubular string.

* * * * *